US009076607B2

(12) United States Patent
Premerlani et al.

(10) Patent No.: US 9,076,607 B2
(45) Date of Patent: Jul. 7, 2015

(54) SYSTEM WITH CIRCUITRY FOR SUPPRESSING ARC FORMATION IN MICRO-ELECTROMECHANICAL SYSTEM BASED SWITCH

(75) Inventors: William James Premerlani, Scotia, NY (US); Kanakasabapathi Subramanian, Clifton Park, NY (US); Kathleen Ann O'Brien, Albany, NY (US); John Norton Park, Rexford, NY (US); Owen Jannis Schelenz, Schenectady, NY (US); Maja Harfman Todorovic, College Station, TX (US)

(73) Assignee: General Electric Company, Niskayuna, NY (US)

( * ) Notice: Subject to any disclaimer, the term of this patent is extended or adjusted under 35 U.S.C. 154(b) by 2201 days.

(21) Appl. No.: 11/866,849

(22) Filed: Oct. 3, 2007

(65) Prior Publication Data

US 2008/0164961 A1 Jul. 10, 2008

Related U.S. Application Data

(63) Continuation-in-part of application No. 11/621,623, filed on Jan. 10, 2007, now Pat. No. 7,542,250.

(51) Int. Cl.
*H01H 1/36* (2006.01)
*H01H 9/54* (2006.01)
(Continued)

(52) U.S. Cl.
CPC ..... *H01H 9/54* (2013.01); *H01H 1/0036* (2013.01); *H01H 9/541* (2013.01); *H01H 9/542* (2013.01); *H01H 59/0009* (2013.01); *H01H 2071/008* (2013.01)

(58) Field of Classification Search
USPC ..... 361/2, 8, 13, 93.1
See application file for complete search history.

(56) References Cited

U.S. PATENT DOCUMENTS 3,496,409 A 2/1970 Connell
3,809,959 A 5/1974 Pucher
(Continued)

FOREIGN PATENT DOCUMENTS

EP 1930922 A2 6/2008
EP 1944779 A2 7/2008
(Continued)

OTHER PUBLICATIONS

State Intellectual Property Office, P.R. China, English Translation of First Office Action issued on Dec. 2, 2010, 6 pages.
(Continued)

*Primary Examiner* — Thienvu Tran
*Assistant Examiner* — Angela Brooks
(74) *Attorney, Agent, or Firm* — Robert M. McCarthy

(57) ABSTRACT

A system that includes micro-electromechanical system switching circuitry is provided. The system may include a first over-current protection circuitry connected in a parallel circuit with the micro-electromechanical system switching circuitry for suppressing a voltage level across contacts of the micro-electromechanical system switching circuitry during a first switching event, such as a turn-on event. The system may further include a second over-current protection circuitry connected in a parallel circuit with the micro-electromechanical system switching circuitry for suppressing a current flow through the contacts of the micro-electromechanical system switching circuitry during a second switching event, such as a turn-off event.

26 Claims, 13 Drawing Sheets

(51) Int. Cl.

| | |
|---|---|
| ***H01H 1/00*** | (2006.01) |
| ***H01H 59/00*** | (2006.01) |
| *H01H 71/00* | (2006.01) |

(56) References Cited

U.S. PATENT DOCUMENTS

| | | | | |
|---|---|---|---|---|
| 4,420,784 | A | 12/1983 | Chen et al. | |
| 4,500,934 | A | 2/1985 | Kinsinger | |
| 4,658,227 | A | 4/1987 | Howell et al. | |
| 4,698,607 | A | 10/1987 | Howell | |
| 4,700,256 | A | 10/1987 | Howell | |
| 4,705,923 | A | 11/1987 | Howell | |
| 4,717,796 | A | 1/1988 | Howell | |
| 4,717,798 | A | 1/1988 | Howell | |
| 4,723,187 | A | 2/1988 | Howell | |
| 4,725,701 | A | 2/1988 | Howell | |
| 5,164,872 | A | 11/1992 | Howell | |
| 5,341,080 | A | 8/1994 | Agut Sanz | |
| 5,374,792 | A | 12/1994 | Ghezzo et al. | |
| 5,430,597 | A | 7/1995 | Bagepalli et al. | |
| 6,054,659 | A | 4/2000 | Lee et al. | |
| 6,563,683 | B1 | 5/2003 | Strumpler | |
| 6,738,246 | B1 * | 5/2004 | Stumpler | 361/93.1 |
| 6,760,202 | B1 | 7/2004 | Meyer et al. | |
| 6,884,950 | B1 | 4/2005 | Nicholson et al. | |
| 7,130,204 | B2 | 10/2006 | Tsuruya | |
| 7,612,971 | B2 * | 11/2009 | Premerlani et al. | 361/33 |
| 7,633,725 | B2 | 12/2009 | Premerlani et al. | |
| 7,643,256 | B2 * | 1/2010 | Wright et al. | 361/8 |
| 7,876,538 | B2 | 1/2011 | Wright et al. | |
| 7,885,043 | B2 * | 2/2011 | Kumfer et al. | 361/2 |
| 8,144,445 | B2 * | 3/2012 | Caggiano et al. | 361/115 |
| 8,358,488 | B2 * | 1/2013 | Premerlani et al. | 361/2 |
| 8,667,325 | B2 * | 3/2014 | Schock | 714/6.13 |
| 8,687,325 | B2 * | 4/2014 | Premerlani et al. | 361/13 |
| 2003/0179527 | A1 * | 9/2003 | Chea, Jr. | 361/91.1 |
| 2003/0183838 | A1 | 10/2003 | Huang et al. | |
| 2004/0150936 | A1 * | 8/2004 | Chea, Jr. | 361/119 |
| 2005/0146404 | A1 | 7/2005 | Yeatman | |
| 2005/0146814 | A1 | 7/2005 | Sellier et al. | |
| 2006/0187688 | A1 | 8/2006 | Tsuruya | |
| 2006/0202933 | A1 | 9/2006 | Pasch et al. | |
| 2007/0139829 | A1 | 6/2007 | Arthur et al. | |
| 2007/0139830 | A1 | 6/2007 | Premerlani et al. | |
| 2007/0139831 | A1 | 6/2007 | Wright et al. | |
| 2008/0137238 | A1 | 6/2008 | Wright et al. | |
| 2008/0164961 | A1 * | 7/2008 | Premerlani et al. | 335/7 |
| 2008/0165457 | A1 * | 7/2008 | Premerlani et al. | 361/31 |
| 2008/0309438 | A1 * | 12/2008 | Caggiano et al. | 335/78 |
| 2008/0310062 | A1 * | 12/2008 | Kumfer et al. | 361/62 |
| 2008/0315980 | A1 * | 12/2008 | Premerlani et al. | 335/18 |
| 2008/0316664 | A1 * | 12/2008 | Premerlani et al. | 361/87 |
| 2009/0107813 | A1 * | 4/2009 | O'Brien et al. | 200/181 |

FOREIGN PATENT DOCUMENTS

| | | | |
|---|---|---|---|
| JP | 44006303 | B | 3/1969 |
| JP | 49006437 | A | 1/1974 |
| JP | 61259416 | A | 11/1986 |
| JP | 63002214 | A | 1/1988 |
| JP | 63131411 | A | 6/1988 |
| JP | 5199091 | A | 8/1993 |
| JP | 5336774 | A | 12/1993 |
| JP | 2000031397 | A | 1/2000 |
| JP | 2002539606 | A | 11/2002 |
| JP | 2005160217 | A | 6/2005 |
| JP | 2006086121 | A | 3/2006 |
| JP | 2006173002 | A | 6/2006 |
| JP | 2008211755 | A | 9/2008 |
| JP | 2010530119 | A | 9/2010 |

OTHER PUBLICATIONS

Search Report and Written Opinion from corresponding EP Application No. 08164432.0-2214 dated Nov. 20, 2012.

European Search Report and Written Opinion EP 08 100272, issued in connection with corresponding EP Application No. 08100272.7-2214 dated Nov. 24, 2009.

Unofficial English translation of Office Action issued in connection with corresponding CN Application No. 200810161963.4 on Apr. 13, 2012.

Notice of Allowance issued in connection with corresponding JP Application No. 2008-191824 dated Jul. 9, 2013.

* cited by examiner

SYSTEM WITH CIRCUITRY FOR SUPPRESSING ARC FORMATION IN MICRO-ELECTROMECHANICAL SYSTEM BASED SWITCH

RELATED APPLICATIONS

The present application is a continuation-in-part of U.S. patent application Ser. No. 11/621,623 filed on Jan. 10, 2007, now U.S. Pat. No. 7,542,250, titled "Micro-Electromechanical System Based Motor Starter", which is herein incorporated by reference in its entirety.

BACKGROUND

Embodiments of the invention relate generally to electrical circuitry, and, more particularly, to micro-electromechanical system (MEMS) based switching devices, and, even more particularly, to system with circuitry for suppressing arc formation during a switching event, such as during a turn on and/or a turn off of the MEMS switching device.

A circuit breaker is an electrical device designed to protect electrical equipment from damage caused by faults in the circuit. Traditionally, most conventional circuit breakers include bulky electromechanical switches. Unfortunately, these conventional circuit breakers are large in size thereby necessitating use of a large force to activate the switching mechanism. Additionally, the switches of these circuit breakers generally operate at relatively slow speeds. Furthermore, these circuit breakers are disadvantageously complex to build and thus expensive to fabricate. In addition, when contacts of the switching mechanism in conventional circuit breakers are physically separated, an arc is typically formed there between which continues to carry current until the current in the circuit ceases. Moreover, energy associated with the arc may seriously damage the contacts and/or present a burn hazard to personnel.

As an alternative to slow electromechanical switches, it is known to use relatively fast solid-state switches in high speed switching applications. As will be appreciated, these solid-state switches switch between a conducting state and a non-conducting state through controlled application of a voltage or bias. For example, by reverse biasing a solid-state switch, the switch may be transitioned into a non-conducting state. However, since solid-state switches do not create a physical gap between contacts when they are switched into a non-conducting state, they experience leakage current. Furthermore, due to internal resistances, when solid-state switches operate in a conducting state, they experience a voltage drop. Both the voltage drop and leakage current contribute to the generation of excess heat under normal operating circumstances, which may be detrimental to switch performance and life.

BRIEF DESCRIPTION

Generally, aspects of the present invention provide a system that includes micro-electromechanical system switching circuitry. A first over-current protection circuitry is connected in a parallel circuit with the micro-electromechanical system switching circuitry. The first over-current protection circuitry is configured to momentarily form an electrically conductive path in response to a first switching event of the micro-electromechanical system switching circuitry. This electrically conductive path forms a parallel circuit with the micro-electromechanical system switching circuitry for suppressing a voltage level across contacts of the micro-electromechanical system switching circuitry during the first switching event. A second over-current protection circuitry is connected in a parallel circuit with the micro-electromechanical system switching circuitry and the first over-current protection circuitry. The second over-current protection circuitry is configured to momentarily form an electrically conductive path in response to a second switching event of the micro-electromechanical system switching circuitry. The electrically conductive path forms a parallel circuit with the micro-electromechanical system switching circuitry for suppressing a current flow through the contacts of the micro-electromechanical system switching circuitry during the second switching event.

Further aspects of the present invention provide a system including a micro-electromechanical system switching circuitry. At least a first over-current protection circuitry may be connected in a parallel circuit with the micro-electromechanical system switching circuitry. The first over-current protection circuitry may be configured to momentarily form an electrically conductive path in response to a first switching event of the micro-electromechanical system switching circuitry. The electrically conductive path forms a parallel circuit with the micro-electromechanical system switching circuitry for suppressing a voltage across contacts of the micro-electromechanical system switching circuitry during the first switching event.

DRAWINGS

These and other features, aspects, and advantages of the present invention will become better understood when the following detailed description is read with reference to the accompanying drawings in which like characters represent like parts throughout the drawings, wherein.

Figure 10:
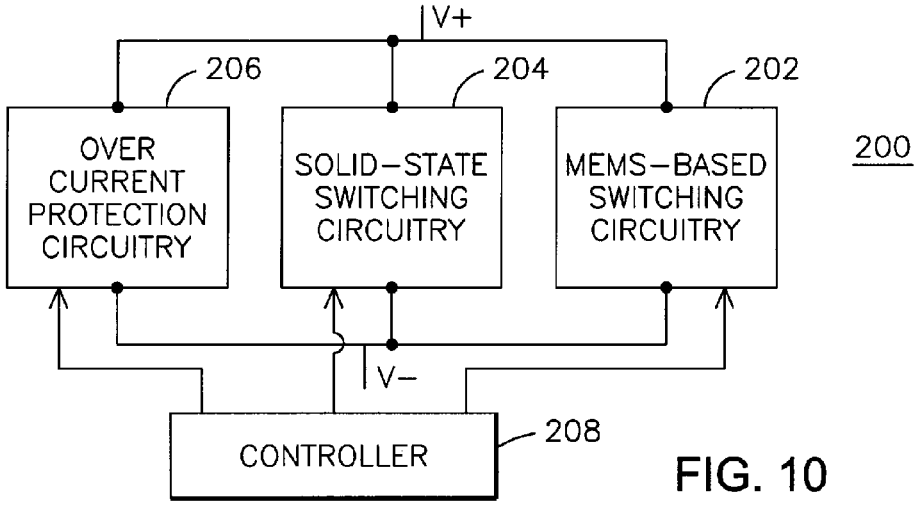
FIG. 10 is a block diagram illustrating an example switching system, in accordance with aspects of the present invention.
Figure 11:
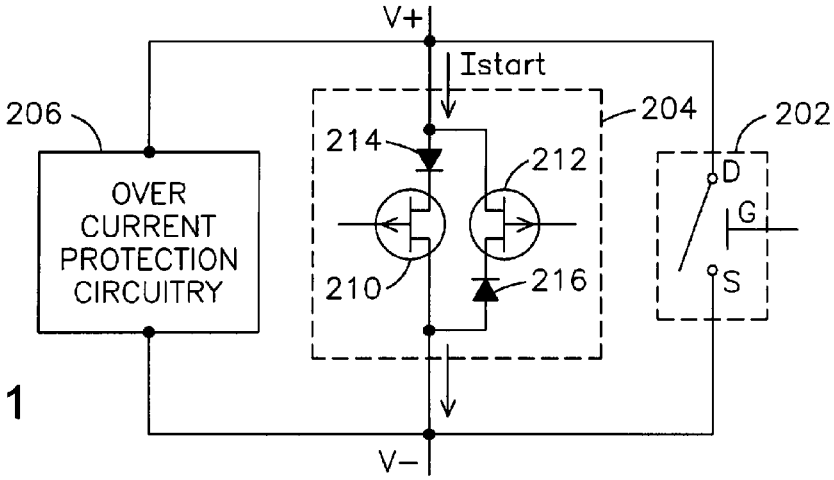
Figure 12:
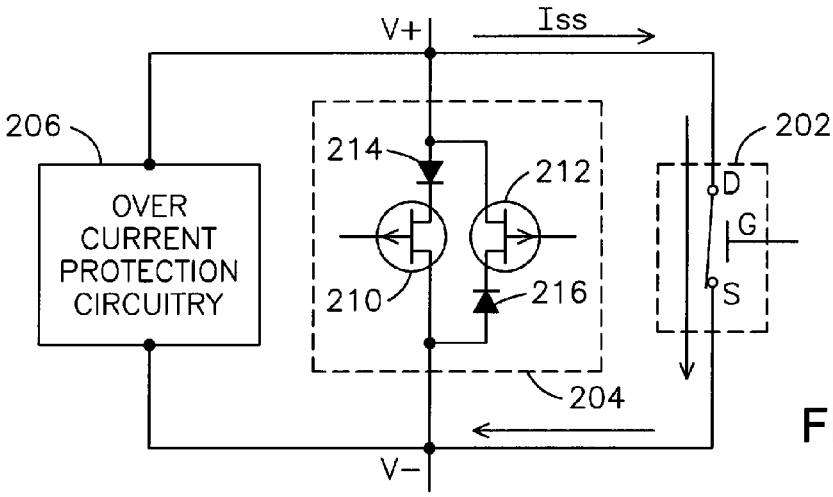
Figure 13:
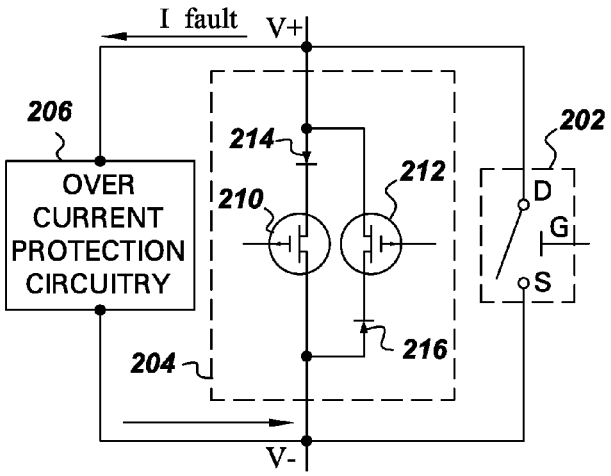

FIGS. 11, 12 and 13 respectively illustrate circuitry details for one example embodiment of the switching system of FIG. 10, wherein FIG. 11 illustrates a current path through respective solid state switching circuitry, such as during a load starting event, FIG. 12 illustrates a current path through respective MEMS-based switching circuitry, such as during steady state operation, and FIG. 13 illustrates a current path through over-current protection circuitry, such as during a fault condition.

Figure 14:
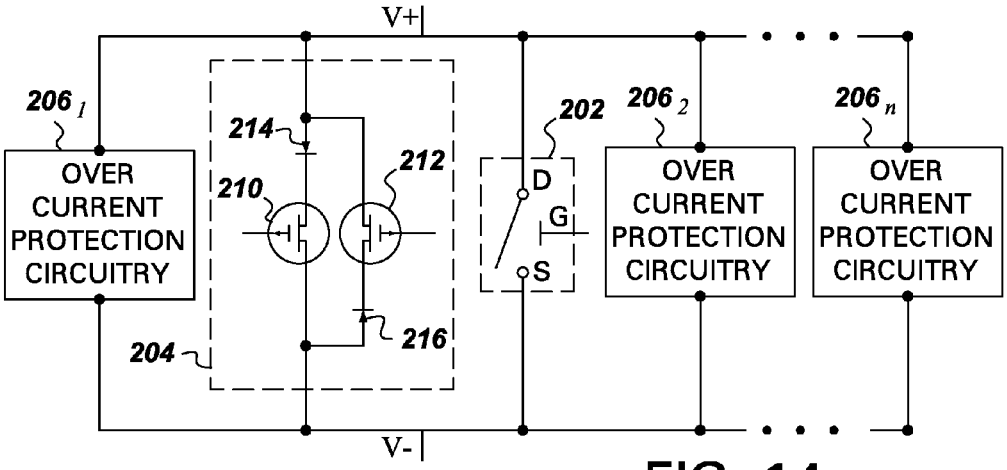

FIG. 14 illustrates a schematic of one example embodiment of a switching system with dual over-current protection circuitry.

Figure 15:
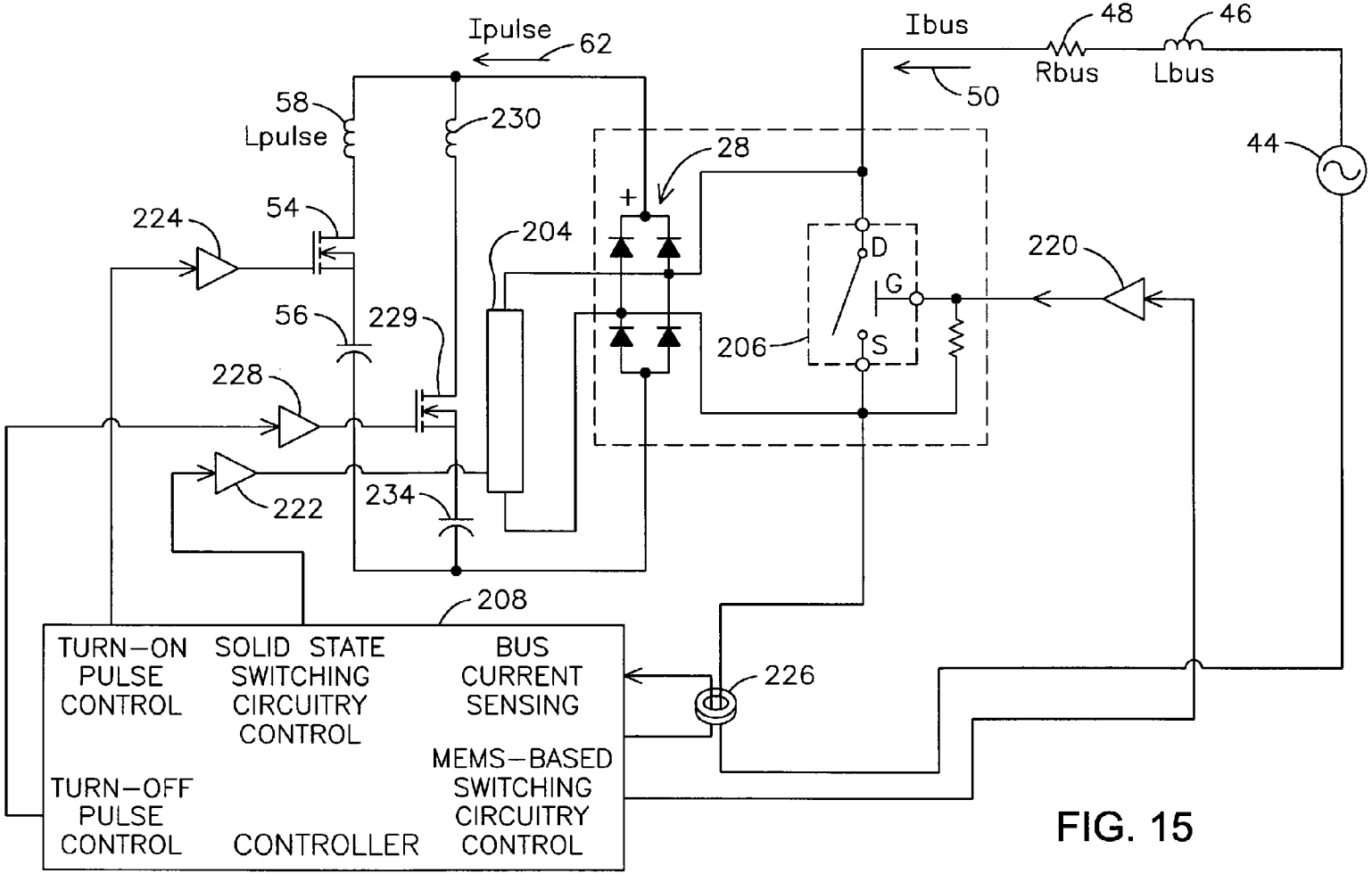

FIG. 15 illustrates circuitry details for one example embodiment of the switching system of FIG. 10.

Figure 16:
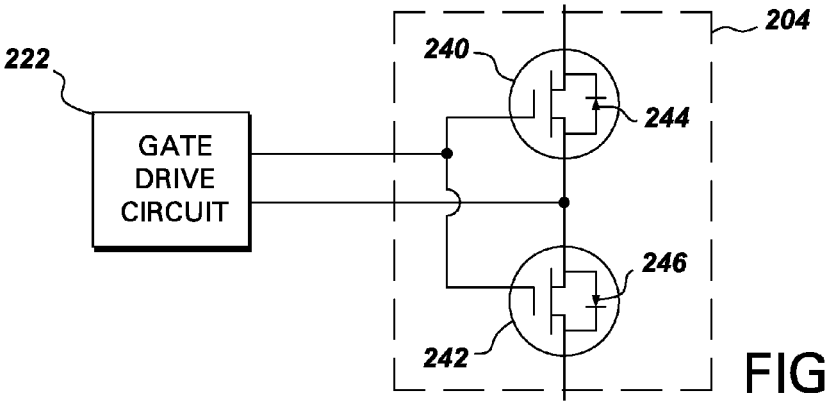

FIG. 16 illustrates an example embodiment wherein solid state switching circuitry comprises a pair of solid state switches connected in an inverse series circuit arrangement.

Figure 17:
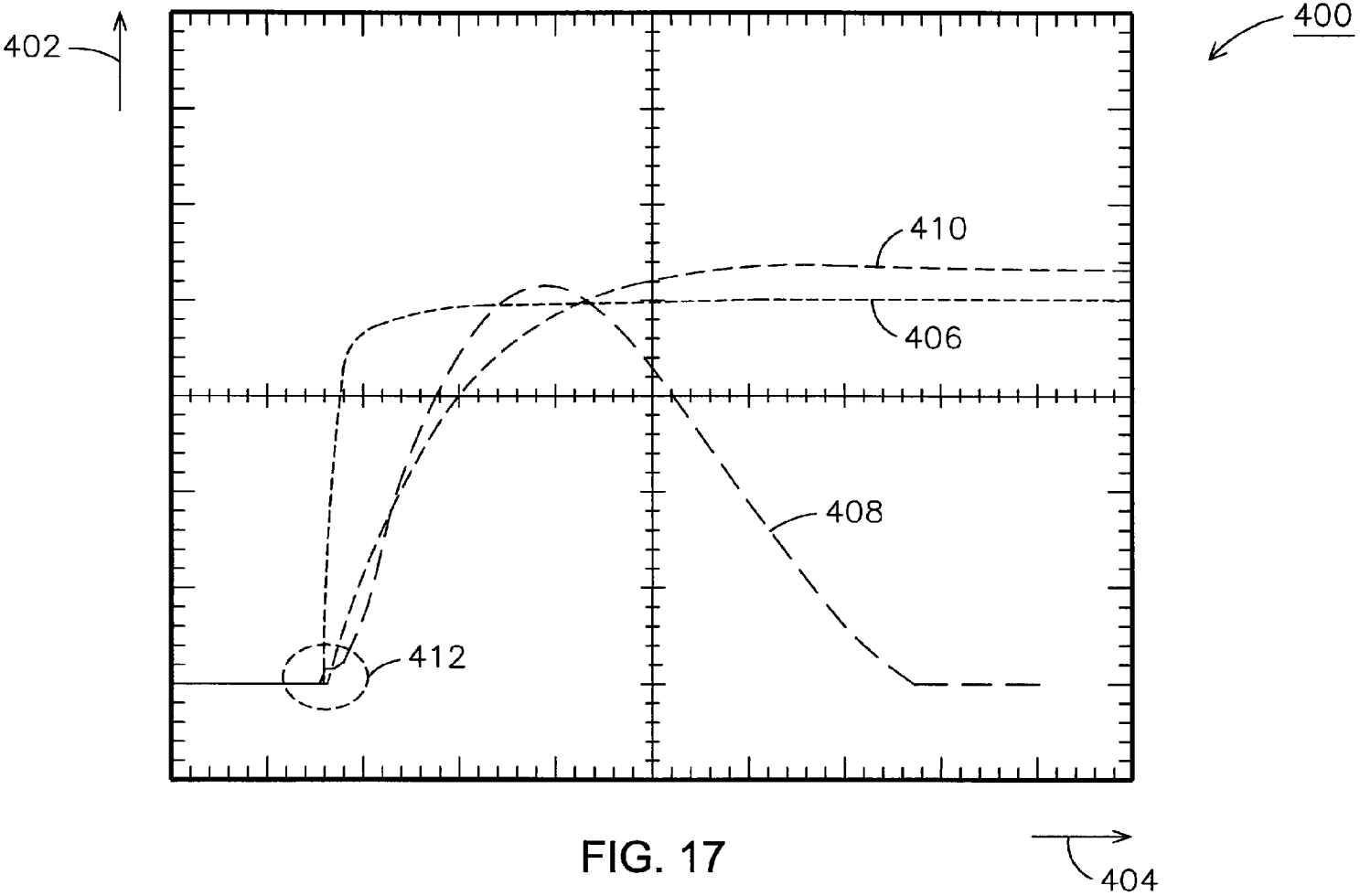
Figure 18:
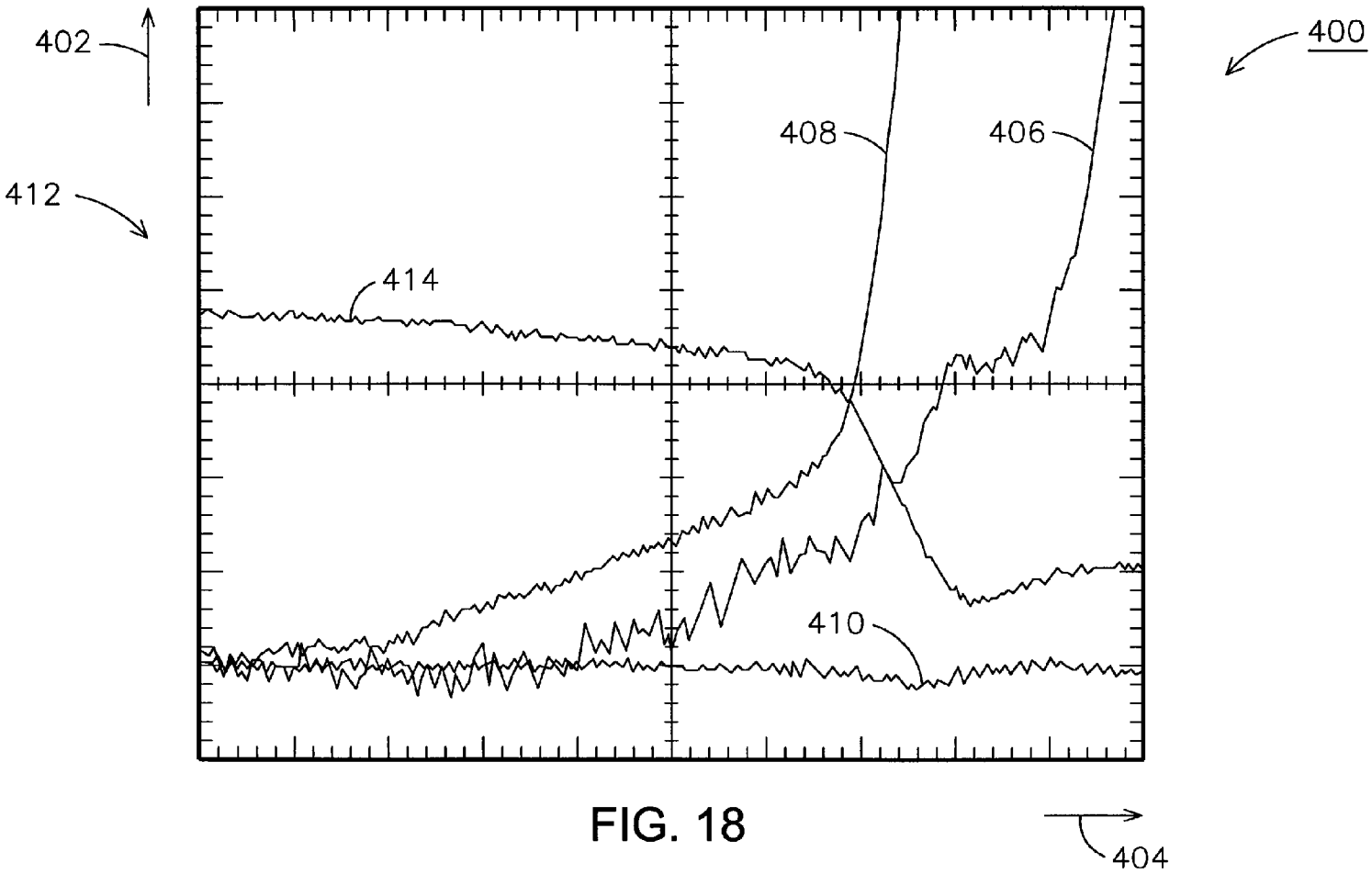

FIGS. 17 and 18 are a graphical representation of experimental results representative of a turn on of the switching system.

DETAILED DESCRIPTION

In accordance with one or more embodiments of the present invention, a system including micro-electromechanical system (MEMS) switching circuitry will be described herein. In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply neither that these operations need to be performed in the order they are presented, nor that they are even order dependent. Moreover, repeated usage of the phrase "in one embodiment" does not necessarily refer to the same embodiment, although it may. Lastly, the terms "comprising", "including", "having", and the like, as used in the present application, are intended to be synonymous unless otherwise indicated.

Figure 1:
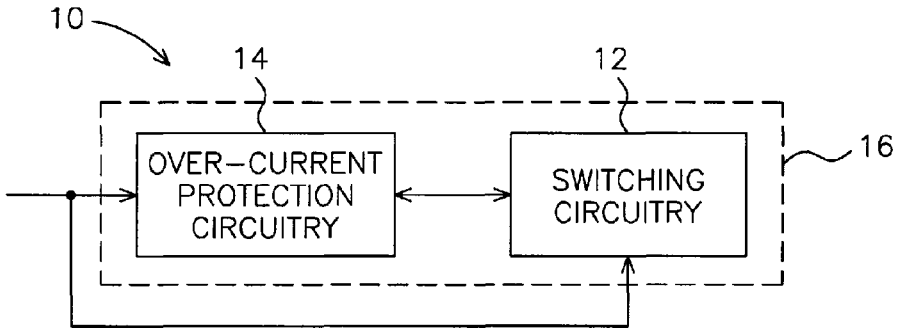
FIG. 1 is a block diagram of an exemplary MEMS based switching system, in accordance with aspects of the present technique.

FIG. 1 illustrates a block diagram of an exemplary micro-electromechanical system (MEMS)-based switching system 10, in accordance with aspects of the present invention. Presently, MEMS generally refer to micron-scale structures that for example can integrate a multiplicity of functionally distinct elements, e.g., mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, e.g., structures that may be smaller than 100 nanometers in size. Accordingly, even though example embodiments described throughout this document may refer to MEMS-based switching system, it is submitted that the inventive aspects of the present invention should be broadly construed and should not be limited to micron-sized devices.

As illustrated in FIG. 1, MEMS based switching system 10 is shown as including MEMS based switching circuitry 12 and over current protection circuitry 14, where the over current protection circuitry 14 is operatively coupled to the MEMS based switching circuitry 12. In certain embodiments, the MEMS based switching circuitry 12 may be integrated in its entirety with the over current protection circuitry 14 in a single package 16, for example. In other embodiments, only certain portions or components of the MEMS based switching circuitry 12 may be integrated with the over current protection circuitry 14.

In a presently contemplated configuration as will be described in greater detail with reference to FIGS. 2-5, the MEMS based switching circuitry 12 may include one or more MEMS switches. Additionally, the over current protection circuitry 14 may include a balanced diode bridge and a pulse circuit. Further, the over current protection circuitry 14 may be configured to facilitate suppression of an arc formation between contacts of the one or more MEMS switches. It may be noted that the over current protection circuitry 14 may be configured to facilitate suppression of an arc formation in response to an alternating current (AC) or a direct current (DC).

For readers desirous of background information in connection with suppression of arc formation reference is made to U.S. patent application Ser. No. 11/314,336 filed on Dec. 20, 2005, which is incorporated by reference in its entirety herein. The foregoing application describes high-speed micro-electromechanical system (MEMS) based switching devices including circuitry and pulsing techniques adapted to suppress arc formation between contacts of the micro-electromechanical system. In such an application, arc formation suppression is accomplished by effectively shunting a current flowing through such contacts.

Figure 2:
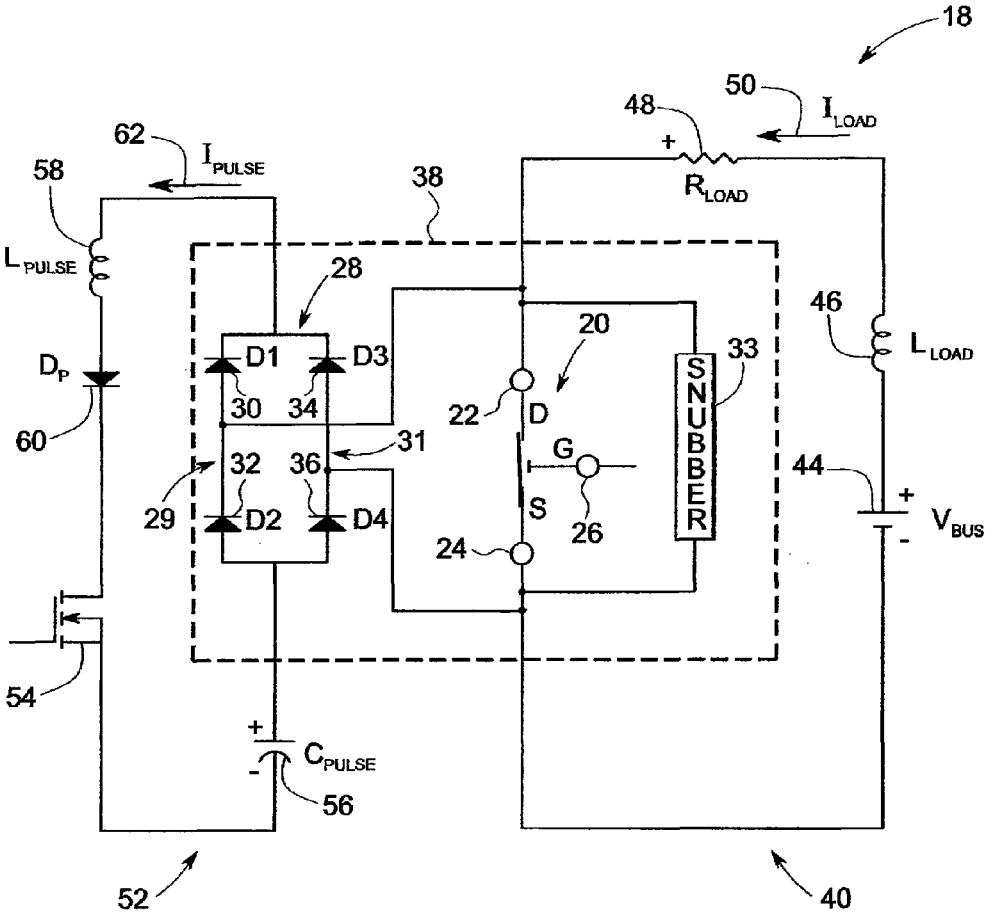
FIG. 2 is schematic diagram illustrating the exemplary MEMS based switching system depicted in FIG. 1.

Turning now to FIG. 2, a schematic diagram 18 of the exemplary MEMS based switching system depicted in FIG. 1 is illustrated in accordance with one embodiment. As noted with reference to FIG. 1, the MEMS based switching circuitry 12 may include one or more MEMS switches. In the illustrated embodiment, a first MEMS switch 20 is depicted as having a first contact 22, a second contact 24 and a third contact 26. In one embodiment, the first contact 22 may be configured as a drain, the second contact 24 may be configured as a source and the third contact 26 may be configured as a gate. Furthermore, as illustrated in FIG. 2, a voltage snubber circuit 33 may be coupled in parallel with the MEMS switch 20 and configured to limit voltage overshoot during fast contact separation as will be explained in greater detail hereinafter. In certain embodiments, the snubber circuit 33 may include a snubber capacitor (not shown) coupled in series with a snubber resistor (not shown). The snubber capacitor may facilitate improvement in transient voltage sharing during the sequencing of the opening of the MEMS switch 20. Furthermore, the snubber resistor may suppress any pulse of current generated by the snubber capacitor during closing operation of the MEMS switch 20. In one example embodiment, snubber 33 may comprise one or more types of circuits, e.g., an R/C snubber and/or a solid-state snubber (such as a metal oxide varistor (MOV) or any suitable overvoltage protection circuit, e.g., a rectifier coupled to feed a capacitor. Preferably, the snubber capacitor should be constructed on each die to avoid inductance issues.

In accordance with further aspects of the present technique, a load circuit 40, such an electromotive machine or electric motor, may be coupled in series with the first MEMS switch 20. The load circuit 40 may be connected to a suitable voltage source $V_{BUS}$, such as an alternating voltage (AC) or a direct voltage (DC) 44. In addition, the load circuit 40 may comprise a load inductance 46 $L_{LOAD}$, where the load inductance $L_{LOAD}$ 46 is representative of a combined load inductance and a bus inductance viewed by the load circuit 40. The load circuit 40 may also include a load resistance $R_{LOAD}$ 48 representative of a combined load resistance viewed by the load circuit 40. Reference numeral 50 is representative of a load circuit current $I_{LOAD}$ that may flow through the load circuit 40 and the first MEMS switch 20.

Further, as noted with reference to FIG. 1, the over current protection circuitry 14 may include a balanced diode bridge. In the illustrated embodiment, a balanced diode bridge 28 is depicted as having a first branch 29 and a second branch 31. As used herein, the term "balanced diode bridge" is used to represent a diode bridge that is configured such that voltage drops across both the first and second branches 29, 31 are substantially equal. The first branch 29 of the balanced diode bridge 28 may include a first diode D1 30 and a second diode D2 32 coupled together to form a first series circuit. In a similar fashion, the second branch 31 of the balanced diode bridge 28 may include a third diode D3 34 and a fourth diode D4 36 operatively coupled together to form a second series circuit.

In one embodiment, the first MEMS switch 20 may be coupled in parallel across midpoints of the balanced diode bridge 28. The midpoints of the balanced diode bridge may include a first midpoint located between the first and second diodes 30, 32 and a second midpoint located between the third and fourth diodes 34, 36. Furthermore, the first MEMS switch 20 and the balanced diode bridge 28 may be tightly packaged to facilitate minimization of parasitic inductance caused by the balanced diode bridge 28 and in particular, the connections to the MEMS switch 20. It may be noted that, in accordance with exemplary aspects of the present technique, the first MEMS switch 20 and the balanced diode bridge 28 are positioned relative to one another such that the inherent inductance between the first MEMS switch 20 and the balanced diode bridge 28 produces a L*di/dt voltage, where L represents the parasitic inductance. The voltage produced may be less than a few percent of the voltage across the drain 22 and source 24 of the MEMS switch 20 when carrying a transfer of the load current to the diode bridge 28 during the MEMS switch 20 turn-off which will be described in greater detail hereinafter. In one embodiment, the first MEMS switch 20 may be integrated with the balanced diode bridge 28 in a single package 38 or optionally, the same die with the intention of minimizing the inductance interconnecting the MEMS switch 20 and the diode bridge 28.

Additionally, the over current protection circuitry 14 may include a pulse circuit 52 coupled in operative association with the balanced diode bridge 28. The pulse circuit 52 may be configured to detect a switch condition and initiate opening of the MEMS switch 20 responsive to the switch condition. As used herein, the term "switch condition" refers to a condition that triggers changing a present operating state of the MEMS switch 20. For example, the switch condition may result in changing a first closed state of the MEMS switch 20 to a second open state or a first open state of the MEMS switch 20 to a second closed state. A switch condition may occur in response to a number of actions including but not limited to a circuit fault, circuit overload, or switch ON/OFF request.

The pulse circuit 52 may include a pulse switch 54 and a pulse capacitor $C_{PULSE}$ 56 series coupled to the pulse switch 54. Further, the pulse circuit may also include a pulse inductance $L_{PULSE}$ 58 and a first diode $D_P$ 60 coupled in series with the pulse switch 54. The pulse inductance $L_{PULSE}$ 58, the diode $D_P$ 60, the pulse switch 54 and the pulse capacitor $C_{PULSE}$ 56 may be coupled in series to form a first branch of the pulse circuit 52, where the components of the first branch may be configured to facilitate pulse current shaping and timing. Also, reference numeral 62 is representative of a pulse circuit current $I_{PULSE}$ that may flow through the pulse circuit 52.

In accordance with aspects of the present invention as will be described in further detail hereinafter, the MEMS switch 20 may be rapidly switched (e.g., on the order of picoseconds or nanoseconds) from a first closed state to a second open state while carrying no current or a near zero current. This may be achieved through the combined operation of the load circuit 40, and pulse circuit 52 including the balanced diode bridge 28 coupled in parallel across contacts of the MEMS switch 20.

Figure 3:
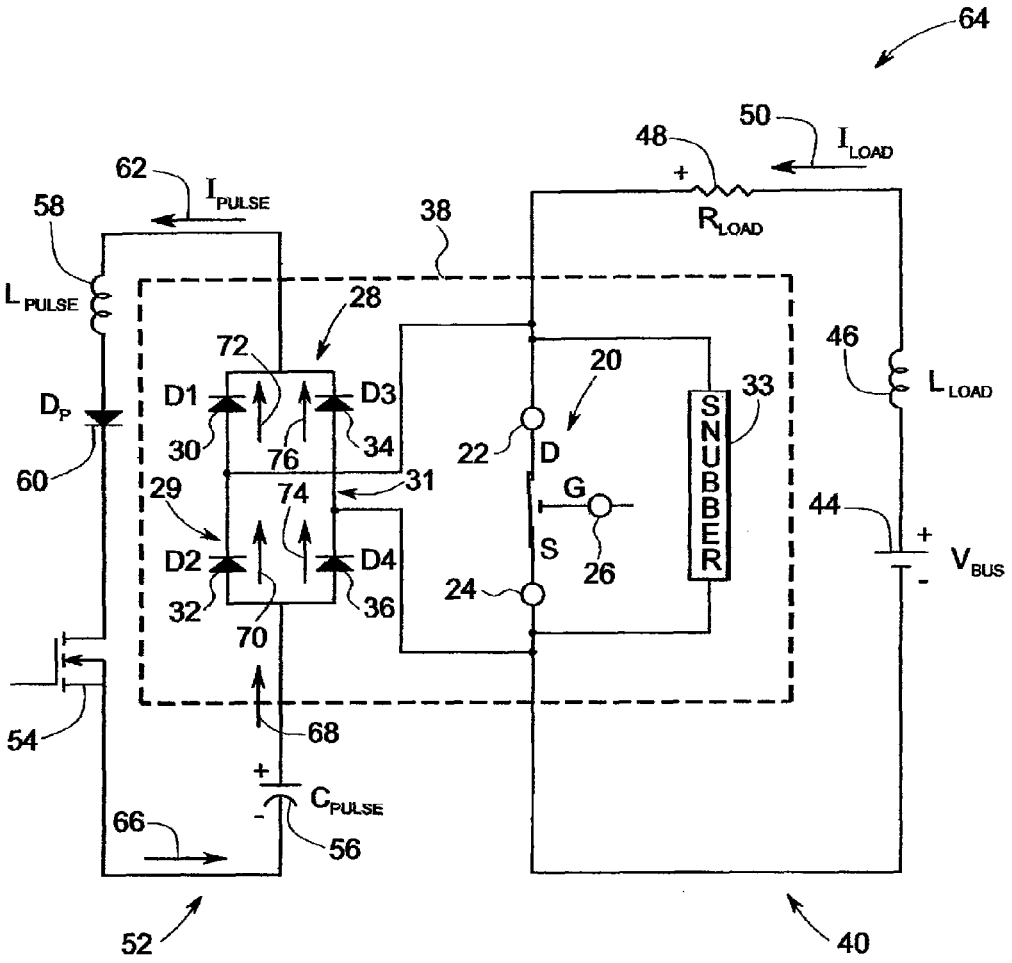
FIGS. 3-5 are schematic flow charts illustrating an example operation of the MEMS based switching system illustrated in FIG. 2.
Figure 4:
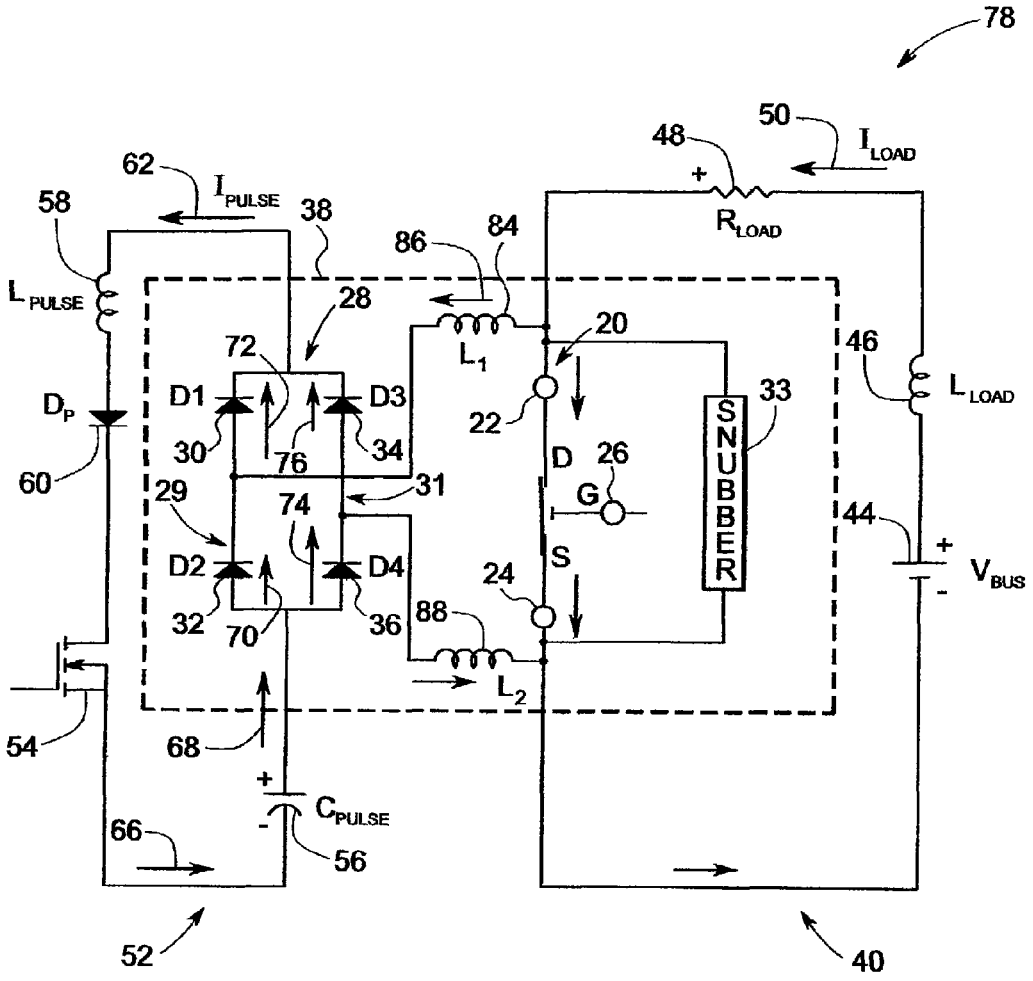
Figure 5:
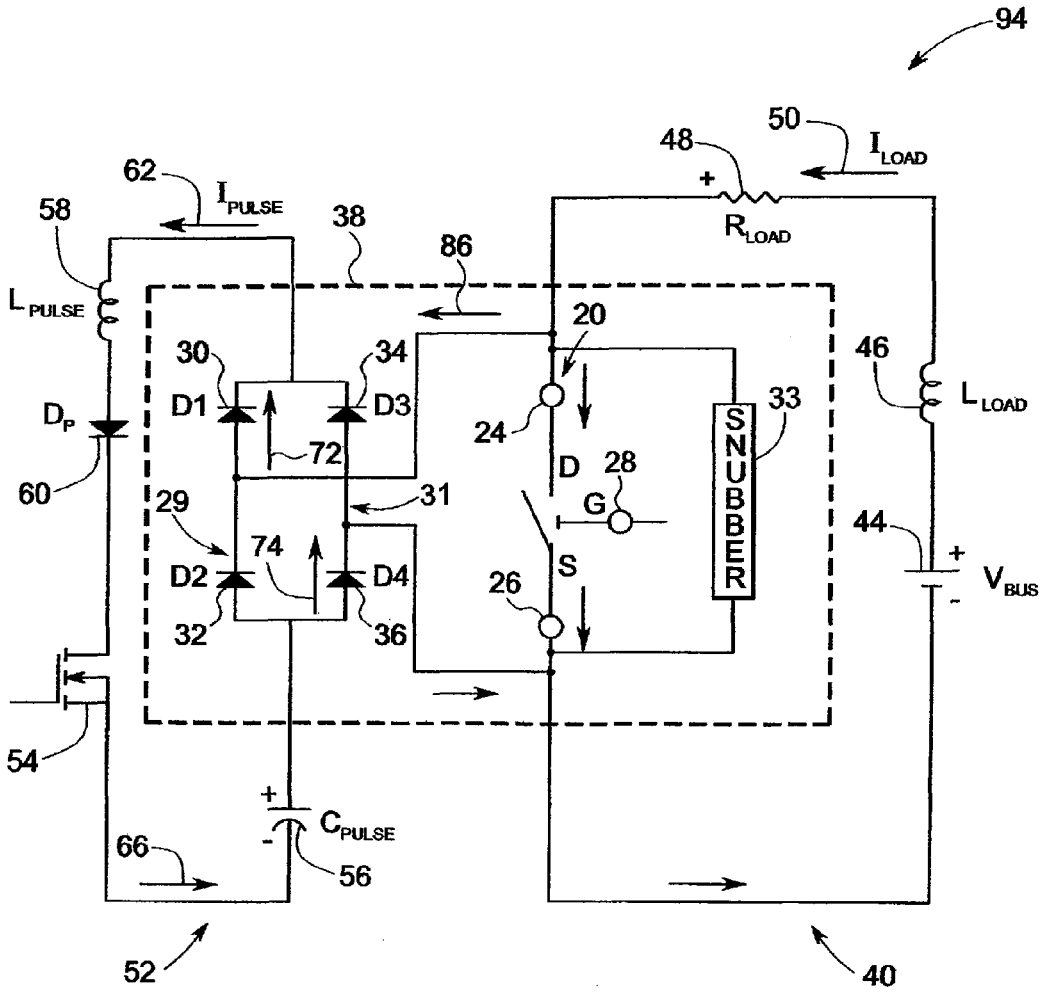

FIGS. 3-5 are used as schematic flow charts to illustrate an example operation of the MEMS based switching system 18 illustrated in FIG. 2. With continuing reference to FIG. 2, an initial condition of the example operation of the MEMS based switching system 18 is illustrated. The MEMS switch 20 is depicted as starting in a first closed state. Also, as indicated, there is a load current $I_{LOAD}$ 50.

Moreover, for discussion of this example operation of the MEMS based switching system 18, it may be presumed that a resistance associated with the MEMS switch 20 is sufficiently small such that the voltage produced by the load current through the resistance of MEMS switch 20 has only a negligible effect on the near-zero voltage difference between the mid-points of the diode bridge 28 when pulsed. For example, the resistance associated with the MEMS switch 20 may be presumed to be sufficiently small so as to produce a voltage drop of less than a few millivolts due to the maximum anticipated load current.

It may be noted that in this initial condition of the MEMS based switching system 18, the pulse switch 54 is in a first open state. Additionally, there is no pulse circuit current in the pulse circuit 52. Also, in the pulse circuit 52, the capacitor $C_{PULSE}$ 56 may be pre-charged to a voltage $V_{PULSE}$, where $V_{PULSE}$ is a voltage that can produce a half sinusoid of pulse current having a peak magnitude significantly greater (e.g., 10×) the anticipated load current $I_{LOAD}$ 50 during the transfer interval of the load current. It may be noted that $C_{PULSE}$ 56 and $L_{PULSE}$ 58 comprise a series resonant circuit.

FIG. 3 illustrates a schematic diagram 64 depicting a process of triggering the pulse circuit 52. It may be noted that detection circuitry (not shown) may be coupled to the pulse circuit 52. The detection circuitry may include sensing circuitry (not shown) configured to sense a level of the load circuit current $I_{LOAD}$ 50 and/or a voltage level of the voltage source $V_{BUS}$ 44, for example. Furthermore, the detection circuitry may be configured to detect a switch condition as described above. In one embodiment, the switch condition may occur due to the current level and/or the voltage level exceeding a predetermined threshold.

The pulse circuit 52 may be configured to detect the switch condition to facilitate switching the present closed state of the MEMS switch 20 to a second open state. In one embodiment, the switch condition may be a fault condition generated due to a voltage level or load current in the load circuit 40 exceeding a predetermined threshold level. However, as will be appreciated, the switch condition may also include monitoring a ramp voltage to achieve a given system-dependent ON time for the MEMS switch 20.

In one embodiment, the pulse switch 54 may generate a sinusoidal pulse responsive to receiving a trigger signal as a result of a detected switching condition. The triggering of the pulse switch 54 may initiate a resonant sinusoidal current in the pulse circuit 52. The current direction of the pulse circuit current may be represented by reference numerals 66 and 68. Furthermore, the current direction and relative magnitude of the pulse circuit current through the first diode 30 and the second diode 32 of the first branch 29 of the balanced diode bridge 28 may be represented by current vectors 72 and 70 respectively. Similarly, current vectors 76 and 74 are representative of a current direction and relative magnitude of the pulse circuit current through the third diode 34 and the fourth diode 36 respectively.

The value of the peak sinusoidal bridge pulse current may be determined by the initial voltage on the pulse capacitor $C_{PULSE}$ 56, value of the pulse capacitor $C_{PULSE}$ 56 and the value of the pulse inductance $L_{PULSE}$ 58. The values for the pulse inductance $L_{PULSE}$ 58 and the pulse capacitor $C_{PULSE}$ 56 also determine the pulse width of the half sinusoid of pulse current. The bridge current pulse width may be adjusted to meet the system load current turn-off requirement predicated upon the rate of change of the load current ($V_{BUS}/L_{LOAD}$) and the desired peak let-through current during a load fault condition. According to aspects of the present invention, the pulse switch 54 may be configured to be in a conducting state prior to opening the MEMS switch 20.

It may be noted that triggering of the pulse switch 54 may include controlling a timing of the pulse circuit current $I_{PULSE}$ 62 through the balanced diode bridge 28 to facilitate creating a lower impedance path as compared to the impedance of a path through the contacts of the MEMS switch 20 during an opening interval. In addition, the pulse switch 54 may be triggered such that a desired voltage drop is presented across the contacts of the MEMS switch 20.

In one embodiment, the pulse switch 54 may be a solid-state switch that may be configured to have switching speeds in the range of nanoseconds to microseconds, for example. The switching speed of the pulse switch 54 should be relatively fast compared to the anticipated rise time of the load current in a fault condition. The current rating required of the MEMS switch 20 may be dependent on the rate of rise of the load current, which in turn is dependent on the inductance $L_{LOAD}$ 46 and the bus supply voltage $V_{BUS}$ 44 in the load circuit 40 as previously noted. The MEMS switch 20 may be appropriately rated to handle a larger load current $I_{LOAD}$ 50 if the load current $I_{LOAD}$ 50 may rise rapidly compared to the speed capability of the bridge pulse circuit.

The pulse circuit current $I_{PULSE}$ 62 increases from a value of zero and divides equally between the first and second branches 29, 31 of the balanced diode bridge 28. In accordance with one embodiment, the difference in voltage drops across the branches 29, 31 of the balanced diode bridge 28 may be designed to be negligible, as previously described. Further, as previously described, the diode bridge 28 is balanced such that the voltage drop across the first and second branches of the diode bridge 28 are substantially equal. Moreover, as the resistance of the MEMS switch 20 in a present closed state is relatively low, there is a relatively small voltage drop across the MEMS switch 20. However, if the voltage drop across the MEMS switch 20 happened to be larger (e.g., due to an inherent design of the MEMS switch), the balancing of the diode bridge 28 may be affected as the diode bridge 28 is operatively coupled in parallel with the MEMS switch 20. In accordance with aspects of the present invention, if the resistance of the MEMS switch 20 causes a significant voltage drop across the MEMS switch 20 then the diode bridge 28 may accommodate the resulting imbalance of the pulse bridge by increasing the magnitude of the peak bridge pulse current.

Referring now to FIG. 4, a schematic diagram 78 is illustrated in which opening of the MEMS switch 20 is initiated. As previously noted, the pulse switch 54 in the pulse circuit 52 is triggered prior to opening the MEMS switch 20. As the pulse current $I_{PULSE}$ 62 increases, the voltage across the pulse capacitor $C_{PULSE}$ 56 decreases due to the resonant action of the pulse circuit 52. In the ON condition in which the switch is closed and conducting, the MEMS switch 20 presents a path of relatively low impedance for the load circuit current $I_{LOAD}$ 50.

Once the amplitude of the pulse circuit current $I_{PULSE}$ 62 becomes greater than the amplitude of the load circuit current $I_{LOAD}$ 50 (e.g., due to the resonant action of the pulse circuit 52), a voltage applied to the gate contact 26 of the MEMS switch 20 may be appropriately biased to switch the present operating state of the MEMS switch 20 from the first closed and conducting state to an increasing resistance condition in which the MEMS switch 20 starts to turn off (e.g., where the contacts are still closed but contact pressure diminishing due the switch opening process) which causes the switch resistance to increase which in turn causes the load current to start to divert from the MEMS switch 20 into the diode bridge 28.

In this present condition, the balanced diode bridge 28 presents a path of relatively low impedance to the load circuit current $I_{LOAD}$ 50 as compared to a path through the MEMS switch 20, which now exhibits an increasing contact resistance. It may be noted that this diversion of load circuit current $I_{LOAD}$ 50 through the MEMS switch 20 is an extremely fast process compared to the rate of change of the load circuit current $I_{LOAD}$ 50. As previously noted, it may be desirable that the values of inductances $L_1$ 84 and $L_2$ 88 associated with connections between the MEMS switch 20 and the balanced diode bridge 28 be very small to avoid inhibition of the fast current diversion.

The process of current transfer from the MEMS switch 20 to the pulse bridge continues to increase the current in the first diode 30 and the fourth diode 36 while simultaneously the current in the second diode 32 and the third diode 34 diminish. The transfer process is completed when the mechanical contacts 22, 24 of the MEMS switch 20 are separated to form a physical gap and all of the load current is carried by the first diode 30 and the fourth diode 36.

Consequent to the load circuit current $I_{LOAD}$ being diverted from the MEMS switch 20 to the diode bridge 28 in direction 86, an imbalance forms across the first and second branches 29, 31 of the diode bridge 28. Furthermore, as the pulse circuit current decays, voltage across the pulse capacitor $C_{PULSE}$ 56 continues to reverse (e.g., acting as a "back electromotive force") which causes the eventual reduction of the load circuit current $I_{LOAD}$ to zero. The second diode 32 and the third diode 34 in the diode bridge 28 become reverse biased which results in the load circuit now including the pulse inductor $L_{PULSE}$ 58 and the bridge pulse capacitor $C_{PULSE}$ 56 and to become a series resonant circuit.

Turning now to FIG. 5, a schematic diagram 94 for the circuit elements connected for the process of decreasing the load current is illustrated. As alluded to above, at the instant that the contacts of the MEMS switch 20 part, infinite contact resistance is achieved. Furthermore, the diode bridge 28 no longer maintains a near-zero voltage across the contacts of the MEMS switch 20. Also, the load circuit current $I_{LOAD}$ is now equal to the current through the first diode 30 and the fourth diode 36. As previously noted, there is now no current through the second diode 32 and the third diode 34 of the diode bridge 28.

Additionally, a significant switch contact voltage difference from the drain 24 to the source 26 of the MEMS switch 20 may now rise to a maximum of approximately twice the $V_{BUS}$ voltage at a rate determined by the net resonant circuit which includes the pulse inductor $L_{PULSE}$ 58, the pulse capacitor $C_{PULSE}$ 56, the load circuit inductor $L_{LOAD}$ 46, and damping due to the load resistor $R_{LOAD}$ 48 and circuit losses. Moreover, the pulse circuit current $I_{PULSE}$ 62, that at some point was equal to the load circuit current $I_{LOAD}$ 50, may decrease to a zero value due to resonance and such a zero value may be maintained due to the reverse blocking action of the diode bridge 28 and the diode $D_P$ 60. The voltage across the pulse capacitor $C_{PULSE}$ 56 due to resonance would reverse polarity to a negative peak and such a negative peak would be maintained until the pulse capacitor $C_{PULSE}$ 56 is recharged.

The diode bridge 28 may be configured to maintain a near-zero voltage across the contacts of the MEMS switch 20 until the contacts separate to open the MEMS switch 20, thereby preventing damage by suppressing any arc that would tend to form between the contacts of the MEMS switch 20 during opening. Additionally, the contacts of the MEMS switch 20 approach the opened state at a much reduced contact current through the MEMS switch 20. Also, any stored energy in the circuit inductance, the load inductance and the source may be transferred to the pulse circuit capacitor $C_{PULSE}$ 56 and may be absorbed via voltage dissipation circuitry (not shown). The voltage snubber circuit 33 may be configured to limit voltage overshoot during the fast contact separation due to the inductive energy remaining in the interface inductance between the bridge and the MEMS switch. Furthermore, the rate of increase of voltage that may be reapplied across the contacts of the MEMS switch 20 during opening may be controlled via use of the snubber circuit (not shown).

It may also be noted that although a gap is created between the contacts of the MEMS switch 20 when in an open state, a leakage current may nonetheless exist between the load circuit 40 and the diode bridge circuit 28 around the MEMS switch 20. (A path could also form through the MOV and/or R/C snubber circuits). This leakage current may be suppressed via introduction of a secondary mechanical switch (not shown) series connected in the load circuit 40 to generate a physical gap. In certain embodiments, the mechanical switch may include a second MEMS switch.

Figure 6A:
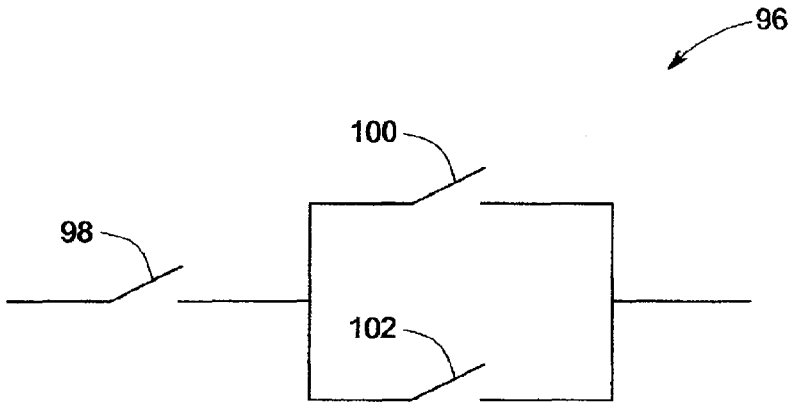
FIG. 6A is schematic diagram illustrating a series-parallel array of MEMS switches.

FIG. 6A illustrates an exemplary embodiment 96 wherein the switching circuitry 12 (see FIG. 1) may include multiple MEMS switches arranged in a series or series-parallel array, for example. Additionally, as illustrated in FIG. 6, the MEMS switch 20 may replaced by a first set of two or more MEMS switches 98, 100 electrically coupled in a series circuit. In one embodiment, at least one of the first set of MEMS switches 98, 100 may be further coupled in a parallel circuit, where the parallel circuit may include a second set of two or more MEMS switches (e.g., reference numerals 100, 102). In accordance with aspects of the present invention, a static grading resistor and a dynamic grading capacitor may be coupled in parallel with at least one of the first or second set of MEMS switches.

Figure 6B:
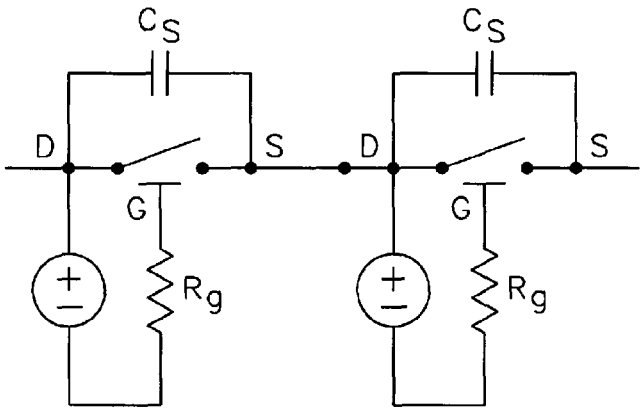
FIGS. 6B and 6C illustrate respective schematics of example embodiments for connecting two or more MEMS switches in series circuit.
Figure 6C:
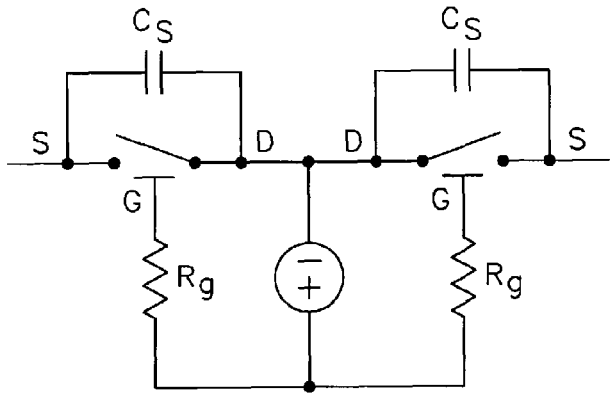

FIGS. 6B and 6C illustrate respective schematics of example embodiments for connecting two or more MEMS switches in series circuit illustrating respective capacitors Cs connected across the drain (D) and source (S) of each serially connected MEMS switch. It was learned during experimental testing that certain constraints generally associated with MEMS switches regarding gate driver speed were more driven by electrical issues, and not by mechanical issues. For example, undesirable capacitive coupling from gate to drain can affect (e.g., slow down) gate driver speed. The inventors of the present invention have recognized the such effects may be reduced by connecting a capacitor Cs from source to drain on each MEMS switch, as illustrated in FIGS. 6B and 6C. The same capacitor Cs also performs the snubber capacitor functionality, as discussed in the context of snubber circuit 33 (FIG. 2).

FIGS. 6B and 6C further illustrate respective gate resistors Rg connected in series circuit relative to the gate (G) of each switch. Such gate resistors are useful to prevent an occurrence of an electrical short at the gate of the switch from disabling the gate driver and potentially disabling operation of additional switches of the switching array that may be connected to the gate driver. One preferred integration technique is to make the gate resistor integral with the switch to avoid introducing capacitance values that may slow down gating speed.

Figure 7:
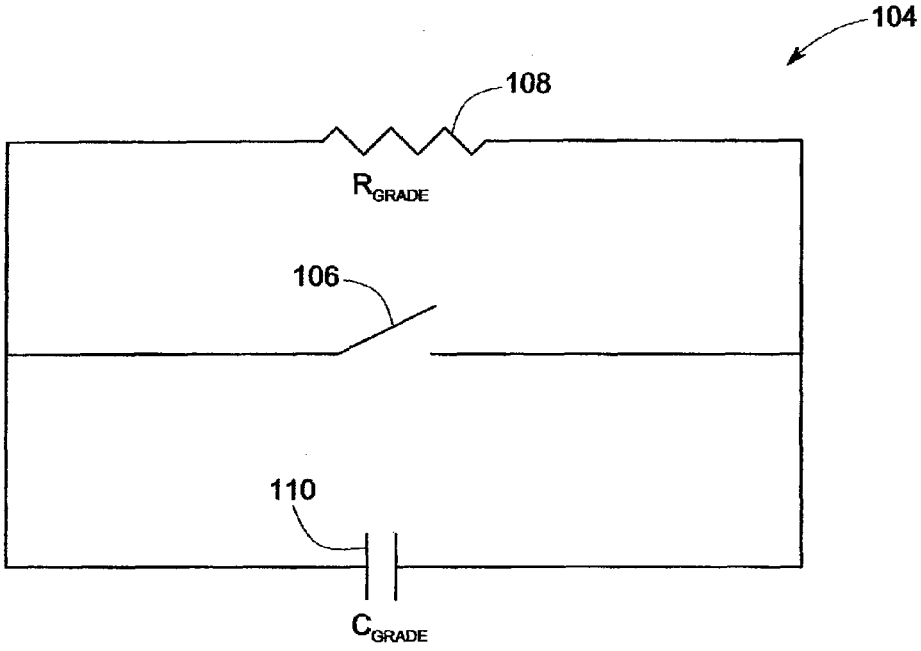
FIG. 7 is schematic diagram illustrating a graded MEMS switch.

Referring now to FIG. 7, an exemplary embodiment 104 of a graded MEMS switch circuit is depicted. The graded switch circuit 104 may include at least one MEMS switch 106, a grading resistor 108, and a grading capacitor 110. The graded switch circuit 104 may include multiple MEMS switches arranged in a series or series-parallel array as for example illustrated in FIG. 6. The grading resistor 108 may be coupled in parallel with at least one MEMS switch 106 to provide voltage grading for the switch array. In an exemplary embodiment, the grading resistor 108 may be sized to provide adequate steady state voltage balancing (division) among the series switches while providing acceptable leakage for the particular application. Furthermore, both the grading capacitor 110 and grading resistor 108 may be provided in parallel with each MEMS switch 106 of the array to provide sharing both dynamically during switching and statically in the OFF state. It may be noted that additional grading resistors or grading capacitors or both may be added to each MEMS switch in the switch array. In certain other embodiments, the grading circuit 104 may include a metal oxide varistor (MOV) (not shown).

Figure 8:
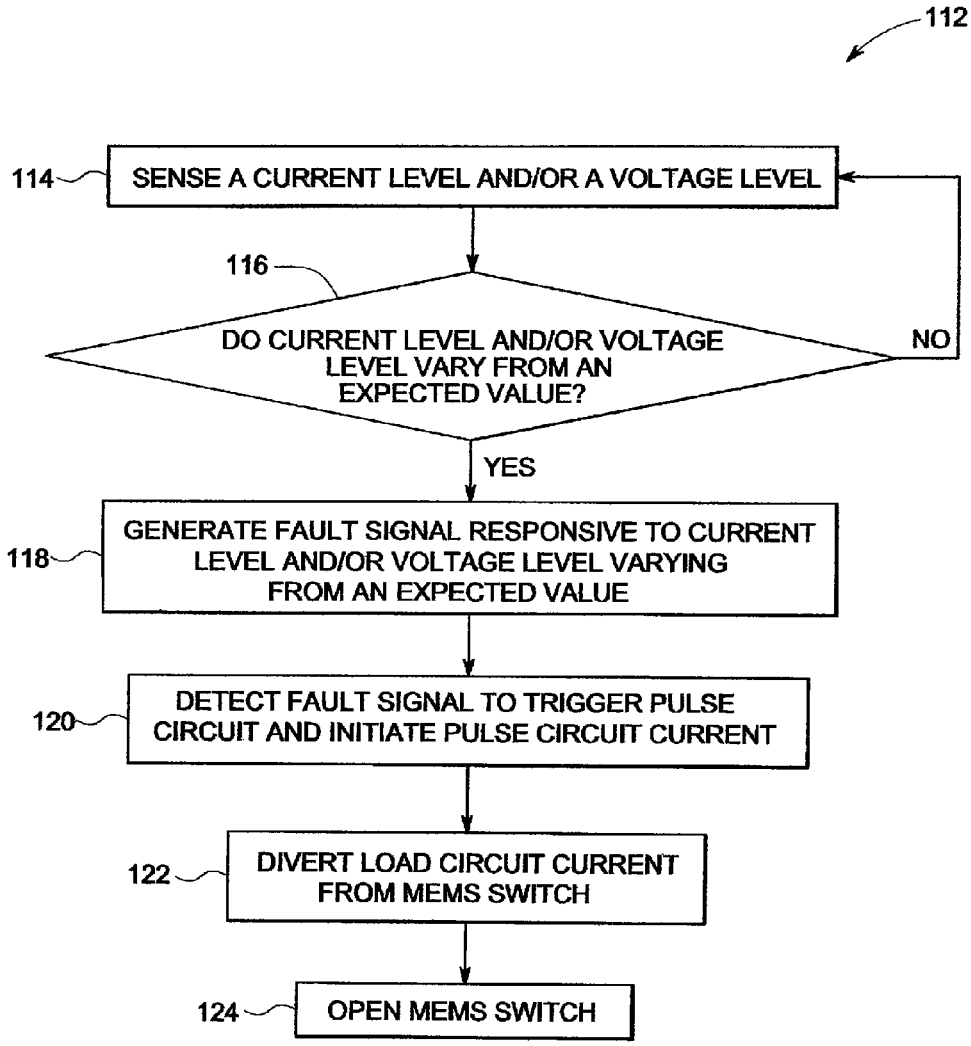
FIG. 8 is a flow diagram depicting an operational flow of a system having the MEMS based switching system illustrated in FIG. 1.

FIG. 8 is a flow chart of exemplary logic 112 for switching a MEMS based switching system from a present operating state to a second state. In accordance with exemplary aspects of the present technique, a method for switching is presented. As previously noted, detection circuitry may be operatively coupled to the over current protection circuitry and configured to detect a switch condition. In addition, the detection circuitry may include sensing circuitry configured to sense a current level and/or a voltage level.

As indicated by block 114, a current level in a load circuit, such as the load circuit 40 (see FIG. 2), and/or a voltage level may be sensed, via the sensing circuitry, for example. Additionally, as indicated by decision block 116 a determination may be made as to whether either the sensed current level or the sensed voltage level varies from and exceeds an expected value. In one embodiment, a determination may be made (via the detection circuitry, for example) as to whether the sensed current level or the sensed voltage level exceeds respective predetermined threshold levels. Alternatively, voltage or current ramp rates may be monitored to detect a switch condition without a fault having actually occurred.

If the sensed current level or sensed voltage level varies or departs from an expected value, a switch condition may be generated as indicated by block 118. As previously noted, the term "switch condition" refers to a condition that triggers changing a present operating state of the MEMS switch. In certain embodiments, the switch condition may be generated responsive to a fault signal and may be employed to facilitate initiating opening of the MEMS switch. It may be noted that blocks 114-118 are representative of one example of generating a switch condition. However as will be appreciated, other methods of generating the switch condition are also envisioned in accordance with aspects of the present invention.

As indicated by block 120, the pulse circuit may be triggered to initiate a pulse circuit current responsive to the switch condition. Due to the resonant action of the pulse circuit, the pulse circuit current level may continue to increase. Due at least in part to the diode bridge 28, a near-zero voltage drop may be maintained across the contacts of the MEMS switch if the instantaneous amplitude of the pulse circuit current is significantly greater than the instantaneous amplitude of the load circuit current. Additionally, the load circuit current through the MEMS switch may be diverted from the MEMS switch to the pulse circuit as indicated by block 122. As previously noted, the diode bridge presents a path of relatively low impedance as opposed to a path through the MEMS switch, where a relatively high impedance increases as the contacts of the MEMS switch start to part. The MEMS switch may then be opened in an arc-less manner as indicated by block 124.

As previously described, a near-zero voltage drop across contacts of the MEMS switch may be maintained as long as the instantaneous amplitude of the pulse circuit current is significantly greater than the instantaneous amplitude of the load circuit current, thereby facilitating opening of the MEMS switch and suppressing formation of any arc across the contacts of the MEMS switch. Thus, as described hereinabove, the MEMS switch may be opened at a near-zero voltage condition across the contacts of the MEMS switch and with a greatly reduced current through the MEMS switch.

Figure 9:
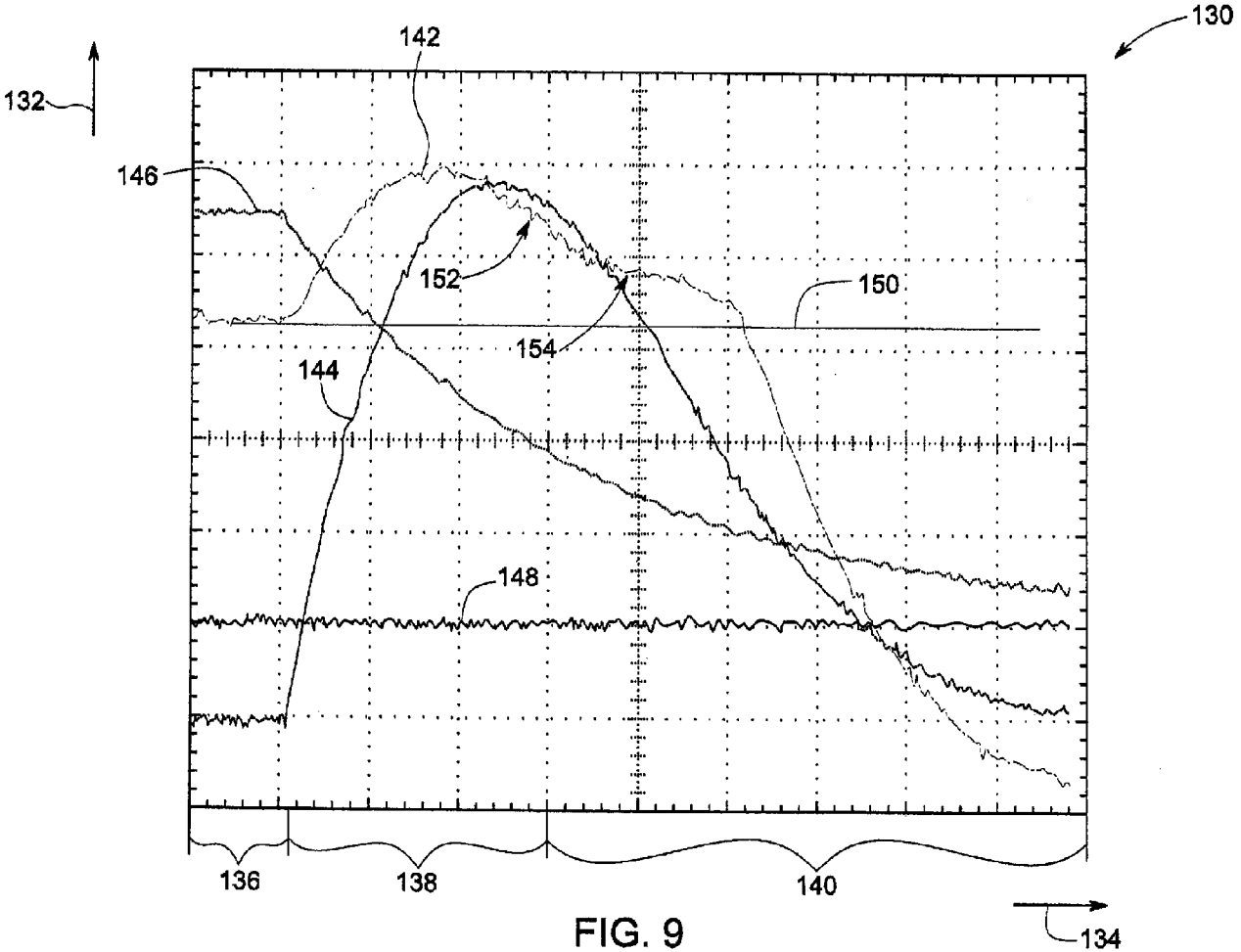
FIG. 9 is a graphical representation of experimental results representative of turn off of the switching system.

FIG. 9 is a graphical representation 130 of experimental results representative of a turn-off switching event in connection with the MEMS switch of the MEMS based switching system, in accordance with aspects of the present technique. As depicted in FIG. 9, a variation in amplitude 132 is plotted against a variation in time 134. Also, reference numerals 136, 138 and 140 are representative of a first section, a second section, and a third section of the graphical illustration 130.

Response curve 142 represents a variation of amplitude of the load circuit current as a function of time. A variation of amplitude of the pulse circuit current as a function of time is represented in response curve 144. In a similar fashion, a variation of amplitude of gate voltage as a function of time is embodied in response curve 146. Response curve 148 represents a zero gate voltage reference, while response curve 150 is the reference level for the load current prior to turn-off.

Additionally, reference numeral 152 represents region on the response curve 142 where the process of switch opening occurs. Similarly, reference numeral 154 represents a region on the response curve 142 where the contacts of the MEMS switch have parted and the switch is in an open state. Also, as can be seen from the second section 138 of the graphical representation 130, the gate voltage is pulled low to facilitate initiating opening of the MEMS switch. Furthermore, as can be seen from the third section 140 of the graphical representation 130, the load circuit current 142 and the pulse circuit current 144 in the conducting half of the balanced diode bridge are decaying.

FIGS. 17 and 18 show a graphical representation 400 of experimental results representative of a turn-on switching event in connection with the MEMS switch of the MEMS based switching system, in accordance with aspects of the present technique. As depicted in FIGS. 17 and 18, a variation in amplitude 402 is plotted against a variation in time 404.

Response curve 406 represents a variation of amplitude of the load circuit current as a function of time. A variation of amplitude of the pulse circuit current as a function of time is represented in response curve 408. In a similar fashion, a variation of amplitude of gate voltage as a function of time is embodied in response curve 410. The reader is cautioned to note the different amplitude scales in connection with the respective plots.

FIG. 18 corresponds to inset 412 shown in FIG. 17, and corresponds to the system initial response during the first few microseconds in connection with a turn-on switching event. Response curve 414 represents voltage across the MEMS switch and partly illustrates the voltage level across the switch prior to turn-on. It is noted that during the time interval shown in FIG. 18, the gate voltage level has not yet been set to actuate the switch in a conducting state. In operation, in response to the pulse, an electrically conductive path for diverting the load current (prior to the switch having been actuated to the conducting state) is formed through the balanced diode bridge.

Below are described circuitry and/or techniques that reliably and cost-effectively allow a switching system to withstand a surge current (e.g., during a start up event or a transient condition) with solid state (e.g., semiconductor-based) switching circuitry while able to, for example, utilize MEMS-based switching circuitry for steady state operation and for addressing fault conditions that may arise.

The surge current may arise when starting up an electrical load, such as a motor or some other type of electrical equipment, or may arise during a transient condition. The value of the surge current during a start up event often comprises multiple times (e.g., six times or more) the value of the steady state load current and can last for several seconds, such as in the order of ten seconds.

FIG. 10 is a block diagram representation of a switching system 200 that connects in a parallel circuit MEMS-based switching circuitry 202, solid-state switching circuitry 204, and an over-current protection circuitry 206, such as may comprise in one example embodiment pulse circuit 52 and balanced diode bridge 31, as shown and/or described in the context of FIGS. 1-9.

A controller 208 may be coupled to MEMS-based switching circuitry 202, solid-state switching circuitry 204, and over-current protection circuitry 206. Controller 208 may be configured to selectively transfer current back and forth between the MEMS-based switching circuitry and the solid state switching circuitry by performing a control strategy configured to determine when to actuate over-current protection circuitry 206, and also when to open and close each respective switching circuitry, such as may be performed in response to load current conditions appropriate to the current-carrying capabilities of a respective one of the switching circuitries and/or during fault conditions that may affect the switching system. It is noted that in such a control strategy it is desirable to be prepared to perform fault current limiting while transferring current back and forth between the respective switching circuitries 202 and 204, as well as performing current limiting and load de-energization whenever the load current approaches the maximum current handling capacity of either switching circuitry.

A system embodying the foregoing example circuitry may be controlled such that the surge current is not carried by MEMS based switching circuitry 202 and such a current is instead carried by solid-state switching circuitry 204. The steady-state current would be carried by MEMS based switching circuitry 202, and over-current and/or fault protection would be available during system operation through over-current protection circuit 206. It will be appreciated that in its broad aspects the proposed concepts need not be limited to MEMS-based switching circuitry. For example, a system comprising one or more standard electromechanical switches (i.e., not MEMS-based electromechanical switching circuitry) in parallel with one or more solid state switches and a suitable controller may similarly benefit from the advantages afforded by aspects of the present invention.

Below is an example sequence of switching states as well as example current values in the switching system upon occurrence of a motor starting event, presuming the load connected to the system is a motor. The letter X next to a number indicates an example current value corresponding to a number of times the value of a typical current under steady state conditions. Thus, 6× denotes a current value corresponding to six times the value of a typical current under steady state conditions.

1. Solid state switching circuitry—Open
   MEMS based switching circuitry—Open
   Current 0
2. Solid state switching circuitry—Closed
   MEMS based switching circuitry—Open
   Current—6×
3. Solid state switching circuitry—Closed
   MEMS based switching circuitry—Closed
   Current—1×
4. Solid state switching circuitry—Open
   MEMS based switching circuitry—Closed
   Current—1×

FIG. 11 illustrates one example embodiment where the solid state switching circuitry 204 in switching system 200 comprises two FET (Field Effect Transistor) switches 210 and 212 (connected in an inverse-parallel configuration with diodes 214 and 216 for enabling conduction of AC current) connected in a parallel circuit with over-protection circuitry 206 and MEMS based switching circuitry 202. The electrical load (not shown) may be activated by turning on the FET switches 210 and 212 which allows start-up current (designated as "Istart") to begin flowing to the load, and in turn allows FET switches 210 and 212 to carry this current during the start-up of the load. It will be appreciated that solid state switching circuitry 204 is neither limited to the circuit arrangement shown in FIG. 11 nor is it limited to FET switches. For instance, any solid state or semiconductor power switching device that provides bidirectional current conduction capability may work equally effective for a given AC application, such as in a TRIAC, RCT, or may be achieved through an appropriate arrangement of at least two such devices, such as IGBTs, FETs, SCRs, MOSFETs, etc.

FIG. 16 illustrates an example embodiment wherein solid state switching circuitry 204 comprises a pair of MOSFET switches 240 and 242 connected in an inverse series circuit arrangement. Note that diodes 244 and 246 comprise body diodes. That is, such diodes comprise integral parts of their respective MOSFET switches. With zero gate drive voltage, each switch is turned off; hence the switches will each block opposite polarities of an alternating voltage while each corresponding diode of the other switch is forward-biased. Upon application of a suitable gate drive voltage from a gate drive circuit 222, each MOSFET will revert to a low resistance state, regardless of the polarity of AC voltage present at the switching terminals.

It is noted that the voltage drop across an inverse-series connected pair of MOSFETs is just the IR drop based on the Rdson (on state resistance) value for the two switches, in lieu of the IR drop based on the Rdson value for one switch plus the relatively larger voltage drop of a diode, as would be the case in an inverse-parallel arrangement. Thus, in one example embodiment an inverse-series configuration of MOSFETs may be desirable since it has the capability of providing a relatively lower voltage drop, hence lower power dissipation, heat, and energy loss.

It will be further appreciated that in one example embodiment wherein solid state switching circuitry 204 comprises a bidirectional thyristor (or an inverse-parallel pair of thyristors), while this arrangement may incur relatively higher losses at lower currents, such an arrangement would have the advantage of being able to withstand a relatively higher short-term current surge because of the relatively lower voltage drop at high currents, and the transient thermal response characteristics.

It is contemplated that in one example embodiment solid state switching circuitry 204 may be used to perform soft-starting (or stopping) of a load, such as motor, by controlling current pulses. By switching the solid state circuitry in correspondence with a variable phase angle of an alternating source voltage or alternating load current, one can adjust the electrical energy resulting from a stream of current pulses applied to the motor. For example, when the motor is first energized, solid state switching circuitry 204 can be turned on close to voltage zero as the voltage is approaching zero. This will produce only a small pulse of current. The current will rise, reach a peak at approximately the time the voltage reaches zero, and then will fall to zero as the voltage reverses. The firing (phase) angle is gradually advanced to produce larger current pulses, until the current reaches a desired value, such as three times rated load. Eventually, as the motor starts up and the current amplitude continues to decay, the firing angle is further advanced until eventually full line voltage is continuously applied to the motor. For readers desirous of general background information regarding an example soft starting technique with solid state switching circuitry, reference is made to U.S. Pat. No. 5,341,080, titled "Apparatus and Three Phase Induction Motor Starting and Stopping Control Method", assigned in common to the same assignee of the present invention.

After the initial start-up current has subsided to a suitable level, MEMS-based switching circuitry 202 may be turned on using a suitable MEMS-compatible switching technique, or by closing into the voltage that is dropped across the solid-state switching circuitry provided such voltage drop comprises a relatively small voltage. At this point, FET switches 210 and 219 can be turned off. FIG. 12 illustrates a condition of switching system 200 wherein the steady-state current (designated as "Iss") is carried by MEMS based switching circuitry 202.

It is noted that MEMS-based switching circuitry should not be closed to a conductive switching state in the presence of a voltage across its switching contacts nor should such circuitry be opened into a non-conductive switching state while passing current through such contacts. One example of a MEMS-compatible switching technique may be a pulse-forming technique as described and/or illustrated in the context of FIGS. 1-9.

Another example of a MEMS-compatible switching technique may be achieved by configuring the switching system to perform soft or point-on-wave switching whereby one or more MEMS switches in the switching circuitry 202 may be closed at a time when the voltage across the switching circuitry 202 is at or very close to zero, and opened at a time when the current through the switching circuitry 202 is at or close to zero. For readers desirous of background information regarding such a technique reference is made to patent application titled "Micro-Electromechanical System Based Soft Switching", U.S. patent application Ser. No. 11/314,879 filed Dec. 20, 2005.

By closing the switches at a time when the voltage across the switching circuitry 202 is at or very close to zero, pre-strike arcing can be avoided by keeping the electric field low between the contacts of the one or more MEMS switches as they close, even if multiple switches do not all close at the same time. As alluded to above, control circuitry may be configured to synchronize the opening and closing of the one or more MEMS switches of the switching circuitry 202 with the occurrence of a zero crossing of an alternating source voltage or an alternating load circuit current. Should a fault occur during a start up event, over-current protection circuitry 206 is configured to protect the down stream load as well as the respective switching circuitries. As illustrated in FIG. 13, this protection is achieved by transferring the fault current (Ifault) to the over-current protection circuitry 206.

It is noted that although electromechanical and solid-state switching circuitry when viewed at a top level may in concept appear to behave substantially similar to one another, in practice, however, such switching circuitry may exhibit respective distinct operational characteristics since they operate based on substantially different physical principles and thus the over-current protection circuitry may have to be appropriately configured to account for such characteristics and still appropriately actuate the switching circuitry. For instance, a MEMS switch may involve a mechanical movement of a cantilever beam to break contact, whereas a field-effect solid-state switch generally involves movement of charge carriers in a voltage-induced channel, and a bi-polar solid state switch involves injection of charge carriers in a reverse-biased junction. The time it takes to clear the carriers is called the recovery time, and this recovery time can range from a time of <1 μs to a time >100 μs. For instance, if the solid-state switch is closed into a fault, then over-current protection circuitry 206 should be able to absorb the fault current and protect the solid-state switch and the down stream load until the switch's channel is fully cleared and the switch is fully open. In the event over-current protection circuitry 206 comprises a pulse circuit 52 and a balanced diode bridge 31, it can be shown that the pulse characteristics (such as the width and/or height of a pulse formed by the pulse circuit) could affect the quality of down stream protection. For example, over-current protection circuitry 206 should be able to generate a pulse having sufficient width and/or height to accommodate the recovery time of the parallel solid-state switching circuitry as well as accommodate the fault protection for the MEMS based switching circuitry.

It is noted that there are two general categories of solid state switching circuitry, with regard to fault current interruption. Some solid state switches (such as FETs) can inherently force a zero current condition when turned off. Others (such as SCRs) cannot force such a zero current condition. Solid state switching circuitry that can force a zero current condition may not need the aid of over-current protection circuitry 206 to perform current limiting during a fault. Solid state switching circuitry that cannot force a zero current condition will generally require an over-current protection circuitry 206.

As previously mentioned, a suitable control technique should be implemented to selectively transfer current back and forth between the MEMS-based switching circuitry and the solid state switching circuitry. In one example embodiment, such a control technique may be based on a respective electrical loss model for each switching circuitry. For instance, electrical losses (and concomitant temperature rise) in MEMS-based switching circuitry are generally proportional to the square of the load current, while losses (and concomitant temperature rise) in solid state switching circuitry are generally proportional to the absolute value of load current. Also, the thermal capacity of solid state devices is generally greater than that of MEMS-based switching circuitry. Accordingly, for normal values of load current, it is contemplated that the MEMS-based switching circuitry will carry the current, while, for temporary overload currents, it is contemplated for the solid state switching circuitry to carry the current. Thus, it is contemplated to transfer current back and forth during transient overload situations.

We will discuss below, three example techniques for selectively transferring load current back and forth between the MEMS-based switching circuitry and the solid state switching circuitry. One example technique contemplates use of dual over-current protection circuitry, such as shown in FIG. 14 where a first over-current protection circuitry $\mathbf{206}_1$ and a second over-current protection circuitry $\mathbf{206}_2$ are connected in parallel circuit with the MEMS-based switching circuitry and the solid state switching circuitry to assist the transfer (this second over-current protection circuitry may also comprise in one example embodiment a pulse circuit 52 and a balanced diode bridge 31, as shown and/or described in the context of FIGS. 1-9).

It is noted that if the switching system uses just a single over-current protection circuitry 206, then such a single over-current protection circuitry would be activated upon a switching event in connection with the MEMS-based switching circuitry. However, if shortly thereafter a fault were to occur, then the single over-current protection circuitry 206 may not be ready to be reactivated to protect the switching circuitry. As described above, over-current protection circuitry 206 operates based on pulsing techniques, and thus such circuitry would not be instantaneously ready to operate shortly upon a pulse firing. For example, one would have to wait some period of time to recharge the pulse capacitor in pulse circuit 52.

The technique involving redundant over-current protection circuitry ensures leaving one over-current protection circuitry (e.g., circuitry $\mathbf{206}_2$) free and ready to assist current limiting in the event of a fault, even when the other over-current protection circuitry $\mathbf{206}_1$ has just performed a pulse-assisted switching in connection with a normal switching event (non-fault driven switching event). This technique is believed to provide substantial design flexibility with a relatively simpler control, but requires dual over-current protection circuitry instead of a single over-current protection circuitry. It is noted that this technique is compatible with any type of solid state switching circuitry.

It will be appreciated that in an example embodiment that comprises redundant over-current protection circuitry, such circuitry should include dual pulse circuits 52 but need not include dual balanced diode bridges 31. For example, if the first over-current protection circuitry comprises a respective pulse circuit 52 and a respective balanced diode bridge 31, the second over-current protection circuitry may just comprise a respective pulse circuit 52 configured to apply a suitable pulse current (when needed) to the balanced diode bridge 31 of the first over protection circuit. Conversely, if the second over-current protection circuitry comprises a respective pulse circuit 52 and a respective balanced diode bridge 31, then the first over-current protection circuitry may just comprise a respective pulse circuit 52 configured to apply a suitable pulse current (when needed) to the balanced diode bridge 31 of the second over protection circuit.

A second example technique is to time the execution of the transfer to coincide with a current zero. This eliminates the need for a second over-current protection circuitry, and is also compatible with any type of solid state switching circuitry. However, this technique may involve relatively more elaborate control and could require a complete shut-off of the system in some cases. A third example technique is to perform the current transfer by coordinating the opening and closing of the MEMS switching circuitry and the solid state switching circuitry. As will be appreciated, this technique can be used provided the solid state switching circuitry has a relatively small voltage drop.

In any case, it should be appreciated that the control strategy may be configured to determine when to operate the over-current protection circuitry (either single or dual over-current protection circuitry) and to determine when to open and close the respective switching circuitries, such as in response to load current conditions appropriate to the current-carrying capabilities of a respective one of the switching circuitries. The general concept is to be prepared to perform fault current limiting while transferring current back and forth between alternate current paths, as well as performing current limiting and circuit de-energization when the load current approaches the maximum capacity of either load current carrying path. One example control strategy may be as follows:

Use the solid state switching circuitry to energize the load, on the expectation that there will be a large initial current. Transfer the load over to the MEMS-based switching circuitry after the current falls within the rating of the MEMS-based switching circuitry.

When it is desired to de-energize the load under normal conditions, do so with whatever switching circuitry is carrying the current at that time. If it is the MEMS-based switching circuitry, use point-on-wave switching to turn off at current zero.

Based on simulated or sensed temperatures, determined the respective temperature of both the MEMS-based switching circuitry and the solid state switching circuitry. If any of such temperature is determined to be approaching a respective thermal ratings limit, or if the load current is approaching a respective maximum current carrying capability, (such as under fault conditions or a severe overload) perform an instantaneous current interruption (assisted with the over-current protection circuitry) and open both the MEMS-based switching circuitry and the solid state switching circuitry. This action would pre-empt any other control action. Wait for a reset before allowing a re-close switching action.

Under normal operation, the respective thermal conditions of each respective switching circuitry may be used to determine whether to pass current through the MEMS-based switching circuitry or through the solid state switching circuitry. If one switching circuitry is approaching its thermal or current limit while the other switching circuitry still has thermal margin, a transfer may be automatically made. The precise timing would depend on the switching transfer technique. For instance, in a pulse-assisted transfer, the transfer can take place essentially instantaneously as soon as the transfer is needed. In a transfer based on point-on-wave switching, such a transfer would be performed (e.g., deferred) until a next available zero crossing of the current occurs. For a deferred transfer, there should be some margin provided in the setting for the decision to transfer in order to make it likely that the transfer can be successfully deferred until the next current zero.

FIG. 15 illustrates circuitry details for one example embodiment of a switching system. For example, FIG. 15 illustrates respective drivers 220, 222, 224 and 228 responsive to control signals from controller 208 for respectively driving MEMS-based switching circuitry 206, solid state switching circuitry 204, a first pulse switch 54 and a second pulse switch 229. In one example embodiment, first pulse switch 54 is coupled to respective pulse capacitor 56 and pulse inductor 58, which in operation constitute a tuned resonant circuit, and may be configured to apply a pulse to bridge diode 28 in connection with a turn-on event of MEMS-based switching circuitry, as described in the context of FIGS. 1-9. That is, to form a pulse at a time appropriately chosen to ensure that the voltage across the terminals of MEMS-based switching circuitry is equal to zero (or substantially close to zero) when the MEMS-based switching circuitry is to close. Essentially, the pulse signal is generated in connection with a turn-on of the micro-electromechanical system switching circuitry to a conductive state.

In this example embodiment, second pulse switch 229 is coupled to respective pulse inductor 230 and pulse capacitor 234, which in operation constitute a tuned resonant circuit, and may be configured to apply a pulse to bridge diode 28 in connection with a turn-off event of MEMS-based switching circuitry. That is, to form a pulse at a time appropriately chosen to ensure that the current through the MEMS-based switching circuitry is equal to zero (or substantially close to zero) when the MEMS-based switching circuitry is to open. Essentially, the pulse signal is generated in connection with a turn-off of the micro-electromechanical system switching circuitry to a non-conductive state. This may be accomplished in combination with the alluded point-on-wave (POW) technique, thereby providing an incremental level of robustness to the switching system design. For example, it is envisioned that this pulse-assisted turn-on technique may allow a switching system embodying aspects of the present invention to be deployed in applications where the quality of the supply voltage may not be suitable for consistently reliable operation with POW switching alone. It is noted that a third pulse circuit (e.g., 206$_n$ of FIG. 14) would ensure providing one pulse circuit free and ready to assist current limiting in the event of a fault, i.e., even when both the first and second pulse circuits have just performed a pulse-assisted switching in connection with a normal switching event (non-fault driven switching event). This is an extension of the redundant over-current protection concepts discussed in connection with FIG. 14.

FIG. 15 further illustrates a current sensor 226 connected to controller 208 to sense current as may be used to determine load current conditions appropriate to the current-carrying capabilities of a respective one of the switching circuitries as well as fault conditions that may affect the switching system.

In one example embodiment, inter-module controls can relay the primary input commands, e.g., providing galvanically isolated control signals for an array of voltage-scalable MEMS switching circuitry modules.

With a voltage grading network and over-current protection circuitry in parallel with MEMS-based switching circuitry, there may be some leakage current in an off state. Accordingly, for applications requiring zero leakage in a tripped state, an isolation contactor may be added. It will be appreciated that such isolation contactor need not be designed to interrupt a large level of load current and thus may just be designed to carry rated current and withstand the applicable dielectric voltages, greatly reducing its size.

It will now be apparent that circuitry embodying aspects of the present invention, as disclosed in the foregoing description, is able to realize in a reliable and cost effective manner each element and/or operational functionality that may be required from a circuit breaker: For example, the inverse time relationship useful for characterizing circuit breakers, e.g., —overcurrent curves defined by (I^2*t=K, wherein the allowable duration of an overload is such that the product of time (t) and the square of the current (I) is a constant K)—may be customarily divided into three segments based on current magnitude: For example, long-time (e.g., larger K), short-time (e.g., smaller K), and instantaneous. It is noted that both the long-time and short-time segments generally involve times much longer than a half cycle, hence are amenable to point-on-wave switching. It is also noted, however, that the instantaneous segment will generally require substantially fast sub-half-cycle switching, as may be provided by MEMS-based switching circuitry, since this could be the result of a short circuit that could reach a potential current of kilo-amperes in less than a millisecond with explosive results. Accordingly, in operation, circuitry embodying aspects of the present invention, innovatively meets each element and/or operational functionality, as may be required in a circuit breaker to meet its operational requirements over each of the foregoing operational segments, for example.

Appendixes 1 and 2 describe some experimental results and analytical underpinnings regarding practical considerations in connection with over current protection circuitry embodying aspects of the present invention.

While only certain features of the invention have been illustrated and described herein, many modifications and changes will occur to those skilled in the art. It is, therefore, to be understood that the appended claims are intended to cover all such modifications and changes as fall within the true spirit of the invention.

APPENDIX 1

Over current protection circuitry embodying aspects of the present invention affords protection to the associated MEMS based switching circuitry during power switching operations, both during opening and closing. Without the use of the diode bridge, the MEMS based switching circuitry, such as an array of MEMS microswitches, could experience damage if the microswitches were closed into a voltage or opened under a load current.

Conceptually, the first microswitch to close during a closing event and the last microswitch to open during an opening event would have to carry the entire burden of the switching operation, something that no individual microswitch may be capable of sustaining. The diode bridge provides a low resistance parallel path to protect the microswitches during switching events. During closing, a first over current protection circuitry is configured to collapse the voltage across the array of switches before they close. During opening, a second over current protection circuitry shunts the current away from the array of switches while they open.

Under idealized conditions, the two branches of the diode bridge that shunt the switch array should behave as a perfect short, establishing a zero voltage drop between the two branches, regardless of how much current is being diverted. Ideally, the switches would switch cold, with no current flowing through them when they open. However, in a practical circuit, the diodes will have some voltage drop, and because the diodes may not necessarily be exactly matched, there may be some residual voltage across the switches when they open, thereby constituting a warm switching. If the voltage is large enough, there may be contact erosion and/or welding under hot switching conditions. In fact, the level of residual voltage across the branches of the diode bridge would essentially define the limits of operation.

Similarly, when the last switch in the array opens, there may be a relatively small amount of current flowing through it that is nearly instantaneously diverted into the second diode bridge, generating a corresponding small inductive voltage kick. This appendix 1 discusses effects of the residual bridge voltage and gives equations that can be used for analysis and design of the diode bridge and snubber circuit. Results are summarized in this appendix 1.

This analysis focuses on turn-off operation because it generally stresses the switches more than turn-on operation. During turn-off operation, an example sequence of events that may be of interest comprise the following:

Prior to generating a turn-off pulse, it is presumed that each switch in a MEMS microswitch parallel array are closed so that they carry the full load current. There may be a voltage across the array, typically a few tenths of a volt, that is equal to the load current times the net resistance of the array. The rise and fall of the hot spot temperatures of the switches in the array in response to the changing array voltage may be obtained from a suitable thermal model of the switches. There will be an average temperature that depends on the rms value of the voltage across the array of switches, and a temperature fluctuation that depends on the changing voltage and the thermal model. The basic point being that prior to triggering the turn-off pulse, the contacts may be hot.

In one example embodiment, the turn-off pulse circuit may form an approximately sinusoidal current pulse that lasts for approximately one half cycle of the resonant frequency of the respective inductor and capacitor. During the time interval that the turn-off current exceeds the load current, all four diodes in the diode bridge conduct current in the forward direction, resulting in a low voltage across the MEMS microswitch array. The voltage may have a relatively small a value, but likely not zero, and changes with time. The specific behavior depends on factors such as how well the bridge is balanced, diode characteristics, load current, and characteristics of the turn-off pulse.

The particulars of the waveform of the voltage across the MEMS switches during turn-off operation may depend on diode characteristics, their parameter variation, the instantaneous turn-off current, and the instantaneous load current. A worst case voltage may occur at the beginning and end of the turn-off pulse, or at the middle. If the bridge is well-balanced, the lowest voltage will be at the peak of the turn-off pulse. Conversely, if the diode bridge is poorly balanced, the highest voltage will be at the peak of the turn-off pulse. If the diode voltage is dominated by diode resistance, the residual voltage will depend mainly on the load current, and will not change very much through the duration of the turn-off pulse.

During the beginning of the turn-off pulse while each switch is still closed, some of the load current diverts from the switch array into the diode bridge, lowering the voltage across the array. However, the amount of current that is diverted is relatively small. This follows since the array of switches generally provides a much lower resistance path than the path through the diode bridge.

At some point in the process, the switches begin to open. In a practical circuit, such switches may not necessarily all open at exactly the same time. There is a distribution in time that depends mostly on mechanical variations, with a time interval between the first and last switch to open of approximately a few hundred nanoseconds. It may be desirable to determine such distribution for a given application.

As each individual switch opens, there is a gradual step-like increase in the value of the array resistance. When a switch begins to open, presuming it is not the last switch in the time distribution, its share of the total load current initially diverts to the remaining closed switches in the array, raising the array voltage and resulting in a voltage unbalance between the array voltage and the diode bridge voltage. The unbalance in voltage appears across the bridge loop inductance, driving an L-R transient that rebalances the sharing of current between the bridge and the array before the next switch opens.

While the first few switches open, most of the load current flows through the remaining closed switches in the array. As more switches open and the resistance of the array rises, the load current diverts into the diode bridge. While the last few switches open, most of the load current flows through the diode bridge, creating a bridge voltage that is the focus of this analysis. The current through the last few switches is equal to the bridge voltage divided by the switch resistance, or equivalent switch resistance for configurations in which there is a series-parallel network of a few closed switches conducting current when the conducting path is finally interrupted.

There will come a time when the residual current through the MEMS switch(es) is interrupted and diverted into the diode bridge, which will constitute warm switching. The amount of current interrupted will depend on the resistance of the switch(es), and the electrical characteristics of the diode bridge. The current could be significantly smaller or larger than the current flowing through the switch prior to turn-off operation, and in turn this current could be significantly smaller or larger than the warm switching capability of the switch. Furthermore, there will be a small inductive voltage kick required to divert the current out of the last switch into the over current protection circuitry (configured for turn-off) in the time interval (e.g., a relatively small fraction of a nanosecond) that it takes for the contacts of the last switch to move from low resistance to open circuit. In fact, from a practical standpoint, the time interval might just as well be zero. In that case, a relatively small snubber capacitor may be provided to control the inductive kick.

As suggested above, the warm switching and the inductive voltage kick during the last step in the sequence of events could lead to contact sticking, welding, melting, and/or arcing. Even if there is not any gross contact damage, there could be subtle contact erosion that could eventually limit the useful life of the contacts.

It is also possible to damage the contacts during turn-on. It is noted that many of the steps applicable during turn-on are the same as that during turn-off, except that such steps may be in a reverse order. Therefore, much of the following analysis applies in either situation. Some notable differences may be as follows:

At the beginning of turn-on, there is no load current flowing. Current may rise rapidly, particularly if there is a fault, but because it is starting from zero it is not expected to be as large as the current that may flow during turn-off operation.

An inductive voltage kick is not expected as in turn-off operation. The flip side of that issue is that the snubber capacitor will deliver current as the switch voltage collapses. However, the snubber capacitor discharge current flows through the diode bridge, not through the MEMS switches.

During turn-off operation, the last switch to divert current into the diode bridge may conduct extra current for a short period of time, on the order of a few hundred nanoseconds, and will be expected to perform warm switching of that current. The amount of current is approximately equal to a residual voltage produced by the diode bridge, divided by the resistance of the switch(es). During switching, an inductive kick may create a short duration, high voltage pulse at the switch, that rises faster than the rate at which the electrical breakdown voltage of the contact gap grows, which could cause arcing for a very short amount of time.

Ideally, while the diode bridge is conducting, we would like the voltage across the array of MEMS switches to be zero. That would create a cold switching condition for the MEMS switches. However, there will be a residual voltage that will result in a "warm switching" condition, and possibly even a "hot switching" condition. There are two effects that can lead to this voltage:

1. The forward voltage across each diode in the bridge is not the idealized value of zero. Rather, each diode produces a small voltage that depends on the current through it. When the last switch in the array opens, most of the load current flows through the diode bridge at that point. Therefore, each diode does not carry exactly the same current. Even if all four diodes in the bridge were exactly identical, the bridge may become unbalanced by the load current, producing a voltage across the last MEMS switch to open.
2. The four diodes in the bridge do not have identical electrical characteristics. This can produce additional bridge unbalance.

The theoretical underpinnings of these two effects are analyzed in the circuit analysis contained in the attached appendix 2. The results are summarized below. An example equivalent circuit during a final stage of the current transfer is shown in illustration E1. The voltage ΔV is the residual voltage across the branches of the diode bridge due to the nominal diode voltages as well as unbalance variations. ΔV establishes the current though the last switch based on voltage divided by the switch resistance, and also establishes a small voltage on the snubber capacitor. The pulse-forming inductor ($L_{HALT}$) and snubber inductor ($C_{SNUB}$) represent respective inductances involved in the transfer. The inductance of the pulse-forming inductor represents the inductance of the loop current required to complete the transfer of current from the switch to the over current protection circuitry, and may be on the order of several tens of nanohenries. The snubber inductance represents stray inductance of the connection of the snubber capacitor to the switch array. The connection should be as tight as feasible to reduce the value of this inductance. It should be possible to limit the stray inductance of the snubber connection to a few nanohenries. The snubber resistance is a resistor that may be connected in series with the snubber capacitor.

The last switch to open is modeled as a contact resistance in series with an idealized switch. It will be appreciated that depending on how fast a switch actually opens, it may be appropriate to model such a switch as a time-varying resistance that starts from the closed contact resistance, and climbs to infinity over a time interval that it takes for the contact pressure to go to zero, such as over a period on the order of magnitude of 0.01 to 10 nanoseconds.

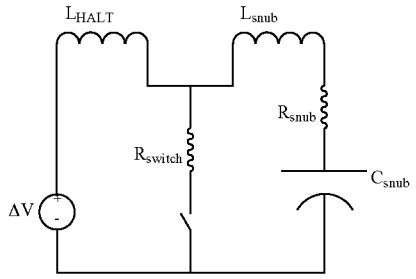

Illustration E1 of Equivalent circuit during a final stage of a warm switching condition Effects of Residual Bridge Voltage The voltage across the last switch to open, ΔV, is equal to the sum of the voltages produced by two effects, and the current is equal to that voltage divided by the contact resistance of one set of contacts, according to equation (1).

$$|\Delta V| = |\Delta V_{nominal}| + |\Delta V_{variation}| = \text{residual voltage across last switch to open} \quad \text{Equation (1)}$$

$$|I_{switch}| = \frac{|\Delta V|}{R_{switch}} = \text{hot-switching current through the last switch to open}$$

$$R_{switch} = \text{resistance of a single contact}$$

$$|\Delta V_{nominal}| = \text{residual voltage due to nominal diode voltage}$$

$$|\Delta V_{variation}| = \text{residual voltage due to diode voltage variation}$$

It will be appreciated that the use of the absolute operator is to emphasize that we do not care about the sign of the voltages, and that we cannot count on the two effects producing voltages with opposite signs. We are concerned just with the magnitudes of the effects, and the magnitude of the totals.

An example model of the voltage-current characteristics of the type of semiconductor diodes that one may use in the diode bridge circuit, during forward conduction, is given by equation (2):

$$V(I, T) = V_D(T) \cdot \ln\left(\frac{I}{I_D(T)} + 1\right) + R_D \cdot I \quad \text{Equation (2)}$$

$I$ = diode current $V$ = diode voltage $V_D(T)$, $I_D(T)$, $R_D$ = diode model parameters $T$ = temperature Starting from the model in equation (2), one may obtain a closed form expression for the voltage across the last switch to open in terms of the turn-off pulse current, the load current, and the diode model parameters, due to the first effect. See appendix 2 for details. An accurate approximation for the residual voltage due to the nominal diode voltage is given by equation (3), where the diode parameters are from equation (2):

$$|\Delta V_{nominal}| \approx V_D \cdot \ln\left(\frac{|I_H| + |I_L|}{|I_H| - |I_L|}\right) + R_D \cdot |I_L| \quad \text{Equation (3)}$$

$|I_L|$ = magnitude of the load current when the last switch opens $|I_H|$ = magnitude of the *HALT* pulse current when the last switch opens It is noted that it is not the peak of the turn-off pulse current that goes into equation (3), rather it is the pulse current that is flowing at the instant that the last switch opens. Equation (3) can also be viewed as expressing the possible nominal residual voltage as a function of time in terms of the turn-off pulse current and load current, as functions of time.

It is instructive to look at a typical situation. First, let us use example diode parameters. As explained in appendix 2, the voltage current characteristics for one of the types of diodes used in our experimental testing, such as diode type PDU540, has model parameters at 25 degrees centigrade given by equation (4).

$$V_D = 0.027 \text{ volts}$$

$$R_D = 0.024 \text{ ohms}$$

$$I_D = 1.0E{-}10 \text{ amps} \quad \text{Equation (4)}$$

In one of our tests we attempted to divert a 10 amp load current with a 40 amp pulse current through a diode bridge built with four PDU540 diodes. Substituting those values and the diode parameters into equation (3), we find that the voltage across the last switch to open and the current to be hot switched, with a 1 ohm contact resistance, is given by:

$$|\Delta V_{nominal}| \approx V_D \cdot \ln\left(\frac{|I_H| + |I_L|}{|I_H| - |I_L|}\right) + R_D \cdot |I_L| \quad \text{Equation (5)}$$

$$|\Delta V_{nominal}| \approx 0.027 \cdot \ln\left(\frac{40 + 10}{40 - 10}\right) + 0.024 \cdot 10$$

$$|\Delta V_{nominal}| \approx 0.138 + 0.24 \approx 0.38 \text{ volts}$$

$$R_{switch} \approx 1 \text{ ohm}$$

$$|I_{switch}| \approx 0.38 \text{ amps}$$

Equation (3) is valid for a single array of parallel switches, a single diode bridge comprising four diodes, and a single turn-off pulse circuit. The equation can be readily extended to other configurations. For example, suppose that everything stays the same, except that at each of the 4 sides of the bridge, there are N diodes in parallel. In that case, the residual voltage is given by:

$$|\Delta V_{nominal}| \approx V_D \cdot \ln\left(\frac{|I_H| + |I_L|}{|I_H| - |I_L|}\right) + \frac{R_D}{N_{parallel}} \cdot |I_L| \quad \text{Equation (6)}$$

$N_{parallel}$ = number of diodes in parallel

Equation (6) reveals, as one may expect, that placing diodes in parallel reduces the effect of the diode resistance. Perhaps less intuitive, but supported by analysis, is the result that the contribution to residual voltage due to the diode semiconductor junction is unchanged. Note that paralleling diodes will also reduce the current though each diode.

Placing diodes in series increases both terms of equation (3), and is not recommended. The voltage for an arrangement with N diodes in series at each side of the bridge is given by:

$$|\Delta V_{nominal}| \approx N_{series} \cdot V_D \cdot \ln\left(\frac{|I_H| + |I_L|}{|I_H| - |I_L|}\right) + N_{series} \cdot R_D \cdot |I_L| \quad \text{Equation (7)}$$

$N_{series}$ = number of diodes in series

Another example configuration is a series-parallel switch array protected by a single diode bridge. Equation (3) is still valid for determining the nominal residual turn-off voltage, but equation (1) should be modified to determine the maximum amount of "hot switched" current. There will come a time during the opening of a series-parallel array of switches when the last switch in one of the parallel modules opens. This switch receives that highest "hot switching" stress, because when it opens, it diverts all of the remaining current though the series-parallel array out of the array and into the diode bridge. At that time there will be a few switches still closed in the other modules, so that the current through the worst-stressed switch will be equal to the residual voltage of the diode bridge, divided by the equivalent resistance of the series-parallel connection of the remaining switches that are still closed. In a worst case scenario, one module could open substantially sooner than all of the other series modules. In that case, the hot-switching current for the last switch will be equal to the residual voltage divided by the resistance of one switch. In the best case, all of the modules open at about the same time in such a way that there is exactly one switch still closed in each of the other series modules. In that case, the hot-switching current for the last switch to open is equal to the residual voltage divided by the resistance of several switches in series.

Another example configuration is to provide a separate turn-off circuit and bridge for each series module. In that case the series modules become decoupled, and equations (1) and (3) can still be applied directly.

Equations (1) and (3) suggest how over current protection circuitry configured for turn-off and MEMS switch arrays may be scaled for current and voltage. Generally, there will always be a last switch to open, no matter how many switches are in parallel. When the last switch opens, the amount of current it will hot switch is equal to the residual voltage, divided by the resistance of one contact. Therefore, to achieve scalability, once we develop a configuration that works at a certain level of load current, to achieve a higher level of load current we must produce the same nominal residual voltage as given by equation (3). This means that one should scale the turn-off pulse current by essentially the same factor as the load current, and we must reduce the diode resistance by the reciprocal of that factor. One way to do that with a given diode type is to use as many diodes in parallel as the scale factor. For example, to go from a first design applicable for switching 10 amps load, with a 40 amp turn-off pulse current, and a single diode of a certain type at each side of the bridge, to a second design applicable for switching a 100 amps load, may require a 400 amp turn-off pulse current and ten diodes in parallel. It is noted that the resistance parameter in equations (2) and (3) includes both the diode resistance as well as the resistance of the electrically conductive traces that carry the turn-off and load currents in the circuit board, so that in practice the thickness of the traces should also be scaled up by the same factor as the load current.

Equation (3) also suggests that one example way to scale for voltage is to provide a separate over current protection circuitry (configured for turn-off) including a respective diode bridge for each series module. That is, each module should be self-contained with respect to all parts and circuits. Higher voltage may then be achieved by stacking such self-contained modules. It is believed that placing diodes in series in a single diode bridge for an entire system would penalize scalability.

We now proceed to analyze the second effect. That is, residual voltage contribution due to variations in diode parameters. One of the assumptions used to derive equation (3) is that the diodes are identical. In fact, in a practical circuit they are not. For example, in the case of PD540 diodes, the voltage-current characteristic is a strong function of temperature. There are several example ways for the diodes to be at different temperatures. For example, they could be near a heat source, such as the switches themselves. They could experience uneven heating during operation of the turn-off circuit. Therefore, one should consider that the four diodes in the bridge may not be at the same temperature, and will cause additional residual voltage. In addition to the voltage given by equation (3), there may be an additional voltage contribution due to an unbalance internal to the diode bridge, given in terms of small shifts in diode parameters. The following equation, derived in the Exhibit, computes a worst case scenario regarding additional residual voltage due to variations in diode parameters. The voltage is expressed in terms of variations in parameters from nominal values:

$$|\Delta V_{variation}| \approx 2\cdot|\Delta V_D|\cdot\ln\left(\frac{\sqrt{I_H^2-I_L^2}}{2\cdot I_D}\right)+2\cdot V_D\cdot\frac{|\Delta I_D|}{I_D}+|I_H|\cdot|\Delta R_D| \quad \text{Equation (8)}$$

$|\Delta V_{variation}|$ = residual voltage due to variations in diodes $\Delta V_D$ = variation in $V_D$ from nominal $\Delta I_D$ = variation in $I_D$ from nominal $\Delta R_D$ = variation in $R_D$ from nominal For a numerical example, suppose that there is a variation in diode parameters of 5% from nominal values for the PDU540 diode for the example in the previous section. In that case, the extra residual voltage is computed as:

$$\Delta V_D = 0.00135\text{ volts} \quad \text{Equation (9)}$$

$$\Delta I_D = 0.5E-11\text{ amps}$$

$$\Delta R_D = 0.0012\text{ ohms}$$

$$|\Delta V_{variation}| \approx .0027\cdot\ln\left(\frac{\sqrt{1600-100}}{1E-11}\right)+0.027\cdot 0.1+40\cdot 0.0012$$

$$|\Delta V_{variation}| \approx 0.078+0.0027+0.048 \approx 0.129\text{ volt}$$

It is noted that one is not suggesting that one will encounter a 5% variation in diode parameters, we are just showing what the effect would be. Note that the largest sensitivity, percentage wise, is due to variations in the diode voltage parameter, which is a strong function of temperature. It is suggested that it will be useful to get an accurate estimate of what the actual parameter variations can be expected, with close scrutiny of temperature effects, and then use equation (8) to estimate the residual voltage. In this example, the total residual voltage is equal to 0.38 volts due to diode nominal voltage plus 0.156 volts due to diode unbalance voltage, for a total of 0.536 volts, which probably exceeds the capability of a single set of contacts.

Combining equations (3) and (8) produces an expression for the total residual voltage at the moment of final transfer of current into the diode bridge, where $I_H$ and $I_L$ are the values of the turn-off pulse current and the load current at the time of the transfer:

$$\boxed{\Delta V \approx V_D\cdot\ln\left(\frac{|I_H|+|I_L|}{|I_H|-|I_L|}\right)+R_D\cdot|I_L|+2\cdot|\Delta V_D|\cdot\ln\left(\frac{\sqrt{I_H^2-I_L^2}}{2\cdot I_D}\right)+2\cdot V_D\cdot\frac{|\Delta I_D|}{I_D}+|I_H|\cdot|\Delta R_D|} \quad \text{Equation (10)}$$

Equation (10) can be used to estimate the total residual voltage across the last switch that transfers current into the diode bridge. Equation (10) shows explicitly some example design tradeoffs. For example, one should note how the turn-off pulse current impacts the residual voltage. Although the first term in equation (10) continues to decrease as the turn-off pulse current is increased, the last term in the equation is proportional to the turn-off current. A plot of equation (10) versus turn-off current would reveal a broad maximum whose location depends on all of the other parameters, including the load current. Equation (10) can be used as a basis for designing a diode bridge that meets the requirements of a given application, MEMS switch characteristics, MEMS array configuration, and other turn-off parameters.

APPENDIX 2

The circuit schematic in illustration A1 can be analyzed to determine the residual bridge voltage due to nominal diode voltages plus parameter variations.

Illustration A1 - Diode Bridge

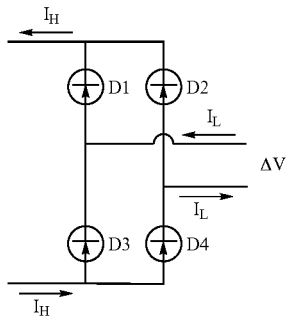

Focus of the analysis is in determining ΔV, the residual bridge voltage resulting from the voltage-current characteristics of the diodes. The current $I_L$ is the load current being shunted away from the MEMS microswitch array. The current $I_H$ is the turn-off pulse current being used to maintain a forward bias on all of the diodes.

A three-parameter diode model that has a sound theoretical basis and which closely fits the forward biased voltage-current characteristics of the diodes is given by equation (A1).

$$V(I, T) = V_D(T) \cdot \ln\left(\frac{I}{I_D(T)} + 1\right) + R_D \cdot I \qquad \text{Equation (A1)}$$

$I$ = diode current $V$ = diode voltage $V_D(T)$, $I_D(T)$, $R_D$ = diode model parameters $T$ = temperature The parameters for the model in equation (A1) can be estimated from published voltage-current curves, which are commonly plotted as the log of the current versus the voltage, at various temperatures. For small values of current and voltage, the first term of equation (A1) dominates so that $V_D$ can be estimated from the slope of the plot and $I_D$ can then be determined by fitting one of the points on the straight line. $R_D$ can then be estimated by the difference between the plotted voltage and the straight line approximation at higher currents. For the PDU540 diode, the following table provides the parameter values at various temperatures:

TABLE 1

Model Parameters for example PDU540 Diode

| T, degrees C. | $V_D$, volts | $I_D$, amps | $R_D$, ohms |
|---|---|---|---|
| −65 | 0.0193 | 7E−18 | 0.024 |
| 25 | 0.0269 | 1E−10 | 0.024 |
| 85 | 0.0317 | 3.4E−8 | 0.024 |
| 125 | 0.033 | 4.6E−7 | 0.024 |

We will start the analysis by assuming that all 4 diodes in illustration A1 have identical models given by equation A1. Denote the forward voltages across each of the diodes as $V_1$, $V_2$, $V_3$ and $V_4$. Denote the forward currents through them as $I_1$, $I_2$, $I_3$ and $I_4$. We wish to determine ΔV, subject to the constraints of the electrical network given by equations (A2):

$$\Delta V_{nominal} = V_1 - V_2 = V_4 - V_3$$

$$I_1 + I_2 = I_3 + I_4 = I_H$$

$$I_1 - I_3 = I_4 - I_2 = I_L \qquad \text{Equation (A2)}$$

The currents can be found by substituting equation (A1) into equations (A2) and solving the resulting system of non-linear equations. The result is given by equations (A3) and (A4) which can be verified by direct substitution:

$$I_1 = \frac{I_H + I_L}{2}; \quad I_2 = \frac{I_H - I_L}{2} \qquad \text{Equation (A3)}$$

$$I_3 = \frac{I_H - I_L}{2}; \quad I_4 = \frac{I_H + I_L}{2}$$

$$V_1 = V_D \cdot \left(\ln\left(\frac{I_H + I_L + 2I_D}{2}\right) - \ln(I_D)\right) + R_D \cdot \left(\frac{I_H + I_L}{2}\right) \qquad \text{Equation (A4)}$$

$$V_2 = V_D \cdot \left(\ln\left(\frac{I_H - I_L + 2I_D}{2}\right) - \ln(I_D)\right) + R_D \cdot \left(\frac{I_H - I_L}{2}\right)$$

$$V_3 = V_D \cdot \left(\ln\left(\frac{I_H - I_L + 2I_D}{2}\right) - \ln(I_D)\right) + R_D \cdot \left(\frac{I_H - I_L}{2}\right)$$

$$V_4 = V_D \cdot \left(\ln\left(\frac{I_H + I_L + 2I_D}{2}\right) - \ln(I_D)\right) + R_D \cdot \left(\frac{I_H + I_L}{2}\right)$$

Substituting equations (A4) into the voltage equations in (A2) produces equation (A5):

$$\Delta V_{nominal} = \qquad \text{Equation (A5)}$$

$$V_1 - V_2 = V_4 - V_3 = V_D \cdot \ln\left(\frac{I_H + I_L + 2I_D}{I_H - I_L + 2I_D}\right) + R_D \cdot I_L$$

In practice, $I_D$ is relatively small compared to $I_H$ and $I_L$. For example, for the PDU540 diode, $I_D$ is never exceeds a fraction of a microamp over the entire rated temperature range of the diode, while $I_H$ and $I_L$ are 10s of amps. Therefore $I_D$ can be ignored in equation (A5), producing the approximation given by equation (A6).

$$\boxed{\Delta V_{nominal} \approx V_D \cdot \ln\left(\frac{I_H + I_L}{I_H - I_L}\right) + R_D \cdot I_L} \qquad \text{Equation (A6)}$$

Equation (A6) is based on the ideal assumption that all 4 diodes have identical current-voltage characteristics and is simply the starting point for a more complete analysis. It is likely that there will be small variations in the electrical model parameters of the diodes that will produce a slight unbalance in the diode bridge, producing additional residual bridge voltage, which can be analyzed as follows:

- The additional residual voltage will be small, on the order of a tenth of a volt. Therefore, the variations in diode parameters will be small, and a Taylor's expansion can be used to express the actual situation as a small deviation from equations (A3) and (A4).
- The voltage across each diode will be expressed as the base voltages given by equations (A4), plus the first order terms in the Taylor's expansion due to variations in diode model parameters and resulting changes in diode currents.
- The diode currents themselves can be expressed in terms of the base currents given by equations (A3), plus a loop unbalance current.
- Applying the constraints of the network results in a system of linear equations that can be solved for the loop unbalance current and the diode voltage shifts.
- The additional residual voltage is expressed in terms of the diode voltage shifts.

First, it is possible to simplify the analysis by using an approximate diode model given by equation (A7). The approximation is justified by the fact that the diode currents will be many orders of magnitude larger than $I_D$.

$$V(I, T) \approx V_D(T) \cdot \ln\left(\frac{I}{I_D(T)}\right) + R_D \cdot I \qquad \text{Equation (A7)}$$

The Taylor's expansion that expresses the change in diode voltage in terms of small shifts in model parameters, the model parameters, and the diode current is given by:

$$\Delta V \approx \Delta V_D \cdot \ln\left(\frac{I}{I_D}\right) - \Delta I_D \cdot \frac{V_D}{I_D} + \Delta R_D \cdot I + \Delta I \cdot \left(\frac{V_D}{I} + R_D\right) \qquad \text{Equation (A8)}$$

Equation (A8) is to be applied separately to each diode. It can be broken into two parts, one part that represents a voltage shift due to parameter shifts, and the other term represents a voltage shift due to a current shift:

$$\Delta V \approx \Delta VO + \Delta I \cdot \left(\frac{V_D}{I} + R_D\right) \qquad \text{Equation (A9)}$$

$$\Delta VO = \Delta V_D \cdot \ln\left(\frac{I}{I_D}\right) - \Delta I_D \cdot \frac{V_D}{I_D} + \Delta R_D \cdot I$$

Note that the parameter shifts can be either up or down, so the minus sign in front of the second term in equation (A9) is really irrelevant. What we are interested in is the magnitude of the voltage shift when the parameter shifts are in directions to create the worst situation:

$$|\Delta VO| = |\Delta V_D| \cdot \ln\left(\frac{I}{I_D}\right) + |\Delta I_D| \cdot \frac{V_D}{I_D} + |\Delta R_D| \cdot I \qquad \text{Equation (A10)}$$

The current shifts for the diodes are related because they should add to zero at each node of the network in FIG. A1. The total current in each diode can be expressed in terms of a current shift and the HALT and load currents according to equations (A11).

$$I_1 = \frac{I_H + I_L}{2} + \Delta I; \quad I_2 = \frac{I_H - I_L}{2} - \Delta I \qquad \text{Equation (A11)}$$

$$I_3 = \frac{I_H - I_L}{2} + \Delta I; \quad I_4 = \frac{I_H + I_L}{2} - \Delta I$$

The voltage shifts at each diode are expressed by equations (A12).

$$\Delta V_1 \approx \Delta VO_1 + \Delta I \cdot \left(\frac{V_D}{I_1} + R_D\right) \qquad \text{Equation (A12)}$$

$$\Delta V_2 \approx \Delta VO_2 - \Delta I \cdot \left(\frac{V_D}{I_2} + R_D\right)$$

$$\Delta V_3 \approx \Delta VO_3 + \Delta I \cdot \left(\frac{V_D}{I_3} + R_D\right)$$

$$\Delta V_4 \approx \Delta VO_4 - \Delta I \cdot \left(\frac{V_D}{I_4} + R_D\right)$$

The sum of the voltage shifts around the diode loop should be zero:

$$\Delta V_1 + \Delta V_2 + \Delta V_3 \Delta V_4 = 0 \qquad \text{Equation (A13)}$$

Combining (A13) with (A12) produces:

$$\Delta VO_1 - \Delta VO_2 + \Delta VO_3 - \Delta VO_4 = -\Delta I \cdot \left(4 \cdot R_D + V_D \cdot \left(\frac{1}{I_1} + \frac{1}{I_2} + \frac{1}{I_3} + \frac{1}{I_4}\right)\right) \qquad \text{Equation (A14)}$$

Substituting equation (A3) into equation (A14) and solving leads to the following expression for the loop current shift:

$$\Delta I = \frac{-\Delta VO_1 + \Delta VO_2 - \Delta VO_3 + \Delta VO_4}{\frac{8 \cdot V_D \cdot I_H}{I_H^2 - I_L^2} + 4 \cdot R_D} \qquad \text{Equation (A15)}$$

As far as the residual voltage at the switches is concerned, we are interested in the difference in the variation between pairs of diodes as expressed in equation (A16).

$$\begin{aligned} \Delta V_{variation} &= \Delta V_1 - \Delta V_2 \\ &= \Delta V_3 - \Delta V_4 \\ &= \Delta VO_1 - \Delta VO_2 + \Delta I \cdot \left(\frac{V_D}{I_1} + \frac{V_D}{I_2} + 2 \cdot R_D\right) \end{aligned} \qquad \text{Equation (A16)}$$

Substituting equations (A15) and (A3) into equation (A16) produces a rather interesting, intuitive, and simple result:

$$\boxed{\Delta V_{variation} = \frac{\Delta VO_1 - \Delta VO_2 - \Delta VO_3 + \Delta VO_4}{2}} \qquad \text{Equation (A17)}$$

There is an intuitive explanation for equation (A17). The terms in the numerator are the diode voltage shifts due to parameter shifts that would occur if the diode bridge were not a closed loop. Only half of each term appears as a residual voltage, because the four diodes in the loop form a voltage divider that divides each contribution virtually in half at the branches of the bridge. The incremental resistance of the series connection of diodes D1 and D2 is exactly the same as the incremental resistance of the series connection of diodes D3 and D4, from symmetry arguments. An increase in the forward drops of diodes D1 or D4 increases the residual voltage in the positive direction while an increase in the forward drops of diodes D2 or D3 increases the residual voltage in the negative direction.

Equations (A10) and (A17) can be used together to estimate the extra residual voltage due to any particular configuration of diode parameter shifts. Equation (A10) is applied to each diode to compute its contribution due the shift of its parameters away from the nominal value. Equation (A17) is then used to compute the overall effect at the switches.

Equations (A10) and (A17) can also be used to estimate the effect due to a worst case scenario. In the worst case the signs of the individual terms could be such that they all reinforce each other, leading to the following approximate expression for the worst case additional residual voltage due to diode variations:

$$|\Delta V_{variation}| \approx 2\cdot|\Delta V_D|\cdot\ln\left(\frac{\sqrt{I_H^2 - I_L^2}}{2\cdot I_D}\right) + 2\cdot|\Delta I_D|\cdot\frac{V_D}{I_D} + |\Delta R_D|\cdot|I_H| \quad \text{Equation (A18)}$$

$|\Delta V_D|$, $|\Delta I_D|$, $|\Delta R_D|$ = variations from average values

The invention claimed is:

1. A system comprising:

micro-electromechanical system switching circuitry;

a first over-current protection circuitry connected in a parallel circuit with the micro-electromechanical system switching circuitry, the first over-current protection circuitry configured to momentarily form a first electrically conductive path in response to a first switching event of the micro-electromechanical system switching circuitry, said first electrically conductive path in a parallel circuit with the micro-electromechanical system switching circuitry for maintaining a substantially zero voltage level across contacts of the micro-electromechanical system switching circuitry during the first switching event; and a second over-current protection circuitry connected in a parallel circuit with the micro-electromechanical system switching circuitry and the first over-current protection circuitry, the second over-current protection circuitry configured to momentarily form a second electrically conductive path in response to a second switching event of the micro-electromechanical system switching circuitry, said second electrically conductive path in a parallel circuit with the micro-electromechanical system switching circuitry for maintaining a substantially zero current flow through the contacts of the micro-electromechanical system switching circuitry during the second switching event.

2. The system of claim 1, wherein each of the first and second electrically conductive paths is formed by way of a balanced diode bridge.

3. The system of claim 2, further comprising a first pulse circuit coupled to the balanced diode bridge, the first pulse circuit comprising a tuned resonant circuit between a capacitor and an inductor, said resonant circuit adapted to form a pulse signal for suppressing the voltage level across the contacts of the micro-electromechanical system switching circuitry, the pulse signal being generated in connection with a turn-on of the micro-electromechanical system switching circuitry to a conductive state, said turn-on constituting the first switching event.

4. The system of claim 2, further comprising a second pulse circuit coupled to the balanced diode bridge, the second pulse circuit comprising a tuned resonant circuit between a capacitor and an inductor, said resonant circuit adapted to form a pulse signal for suppressing the current flow through the contacts of the micro-electromechanical system, the pulse signal being generated in connection with a turn-off of the micro-electromechanical system switching circuitry to a non-conductive state, said turn-off constituting the second switching event.

5. The system of claim 1, further comprising solid state switching circuitry coupled in a parallel circuit with the micro-electromechanical switching circuitry and the first over-current protection circuitry.

6. The system of claim 5, further comprising a controller coupled to the electromechanical switching circuitry and the solid state switching circuitry, the controller configured to perform selective switching of a load current from a load connected to the switching system, the selective switching performed between the electromechanical switching circuitry and the solid state switching circuitry in response to a load current condition appropriate to an operational capability of a respective one of the switching circuitries.

7. The system of claim 6, wherein the controller is configured to perform arc-less switching of the micro-electromechanical system switching circuitry responsive to a detected zero crossing of an alternating source voltage or alternating load current.

8. The system of claim 1, wherein the micro-electromechanical system switching circuitry comprises a first plurality of micro-electromechanical switches electrically coupled in a series circuit.

9. The system of claim 8, wherein each of said first plurality of micro-electromechanical switches is coupled to a respective capacitor connected across a drain and a source of each respective switch, said capacitor adapted to avoid gating speed reduction due to intrinsic capacitive coupling that develops across a gate and the drain of each switch.

10. The system of claim 9, wherein said capacitor further constitutes a snubbing capacitor to delay formation of a voltage across the respective micro-electromechanical system switch.

11. The system of claim 8, wherein each of said first plurality of micro-electromechanical switches is coupled to a respective resistor connected in series circuit to a gate of each respective switch, said resistor adapted to avoid a disablement of a gate driver connected to the gate of the respective switch in the event an electrical short develops at the gate of the switch.

12. The system of claim 8, wherein at least one of the first plurality of micro-electromechanical switches is further coupled in a parallel circuit comprising a second plurality of micro-electromechanical switches.

13. A system comprising:

switching circuitry;

at least a first over-current protection circuitry connected in a parallel circuit with the switching circuitry, the first over-current protection circuitry configured to momentarily form a first electrically conductive path in response to a first switching event of the switching circuitry, said first electrically conductive path in a parallel circuit with the switching circuitry for maintaining a substantially zero voltage across contacts of the switching circuitry during the first switching event; and a second over-current protection circuitry connected in a parallel circuit with the switching circuitry and the first over-current protection circuitry, the second over protection circuitry configured to momentarily form a second electrically conductive path in response to a second switching event of the switching circuitry, said second electrically conductive path in a parallel circuit with the switching circuitry for maintaining a substantially zero current flow through the contacts of the switching circuitry during the second switching event.

14. The system of claim 13, wherein each of the first and second electrically conductive paths is formed by way of a balanced diode bridge.

15. The system of claim 14, further comprising a first pulse circuit coupled to the balanced diode bridge, the first pulse circuit comprising a tuned resonant circuit between a capacitor and an inductor, said resonant circuit adapted to form a pulse signal for suppressing the voltage level across the contacts of the switching circuitry, the pulse signal being generated in connection with a turn-on of the switching circuitry to a conductive state, said turn-on constituting the first switching event.

16. The system of claim 15, further comprising a second pulse circuit coupled to the balanced diode bridge, the second pulse circuit comprising a tuned resonant circuit between a capacitor and an inductor, said resonant circuit adapted to form a pulse signal for suppressing the current flow through the contacts of the switching circuitry, the pulse signal being generated in connection with a turn-off of the switching circuitry to a non-conductive state, said turn-off constituting the second switching event.

17. The system of claim 13, wherein the switching circuitry includes micro-electromechanical switching circuitry, further comprising solid state switching circuitry coupled in a parallel circuit with the micro-electromechanical switching circuitry and the first over-current protection circuitry.

18. The system of claim 17, further comprising a controller coupled to the micro-electromechanical switching circuitry and the solid state switching circuitry, the controller configured to perform selective switching of a load current from a load connected to the system, the selective switching performed between the micro-electromechanical switching circuitry and the solid state switching circuitry in response to a load current to be interrupted by the system.

19. The system of claim 18, wherein the interruption of the load circuit is configured to occur over a time segment that varies from multiple times longer than a half cycle switching to instantaneous switching based on a magnitude of the load current.

20. The system of claim 18, wherein the controller is configured to perform arc-less switching of the micro-electromechanical system switching circuitry responsive to a detected zero crossing of an alternating source voltage or alternating load current.

21. The system of claim 17, further comprising a third over-current protection circuitry connected in a parallel circuit with the micro-electromechanical system switching circuitry, the solid state switching circuitry, and the first and second over-current protection circuitry.

22. The system of claim 21, wherein the third over-current protection circuitry is configured to enable protection against a fault current in a load connected to the system without having to wait for readiness of the first over-current protection circuitry and second over-current protection circuitry subsequent to respective pulse signals having been just generated by the first pulse and second pulse circuits in connection with the first and second switching events of the micro-electromechanical system switching circuitry.

23. The system of claim 13, wherein the micro-electromechanical system switching circuitry comprises a first plurality of micro-electromechanical switches electrically coupled in a series circuit.

24. The system of claim 23, wherein each of said first plurality of micro-electromechanical switches is coupled to a respective capacitor connected across a drain and a source of each respective switch, said capacitor adapted to avoid gating speed reduction due to intrinsic capacitive coupling that develops across a gate and the drain of each switch.

25. The system of claim 23, wherein each of said first plurality of micro-electromechanical switches is coupled to a respective resistor connected in series circuit to a gate of each respective switch, said resistor adapted to avoid a disablement of a gate driver connected to the gate of the respective switch in the event an electrical short develops at the gate of the switch.

26. The system of claim 23, wherein at least one of the first plurality of micro-electromechanical switches is further coupled in a parallel circuit comprising a second plurality of micro-electromechanical switches.

* * * * *

UNITED STATES PATENT AND TRADEMARK OFFICE

CERTIFICATE OF CORRECTION

PATENT NO. : 9,076,607 B2
APPLICATION NO. : 11/866849
DATED : July 7, 2015
INVENTOR(S) : Premerlani et al.

It is certified that error appears in the above-identified patent and that said Letters Patent is hereby corrected as shown below:

ON THE TITLE PAGE

On the Page 2, in Item (56), under "U.S. PATENT DOCUMENTS", in Column 1, Line 17, delete "Stumpler" and insert -- Strumpler --, therefor.

IN THE SPECIFICATION

In Column 12, Line 25, delete "bridge 31," and insert -- bridge 28, --, therefor.

In Column 15, Line 26, delete "bridge 31," and insert -- bridge 28, --, therefor.

In Column 16, Line 8, delete "bridge 31," and insert -- bridge 28, --, therefor.

In Column 16, Line 37, delete "bridges 31." and insert -- bridges 28. --, therefor.

In Column 16, Line 39, delete "bridge 31," and insert -- bridge 28, --, therefor.

In Column 16, Line 42, delete "bridge 31" and insert -- bridge 28 --, therefor.

In Column 16, Line 45, delete "bridge 31," and insert -- bridge 28, --, therefor.

In Column 16, Line 48, delete "bridge 31" and insert -- bridge 28 --, therefor.

In Column 17, Line 53, delete "circuitry 206," and insert -- circuitry 202, --, therefor.

In Column 30, Line 28, in Equation (A13), delete "$\Delta V_1+\Delta V_2+\Delta V_3\Delta V_4=0$" and insert -- $\Delta V_1+\Delta V_2+\Delta V_3+\Delta V_4=0$ --, therefor.

Signed and Sealed this
Twenty-fourth Day of November, 2015

Michelle K. Lee

Michelle K. Lee
*Director of the United States Patent and Trademark Office*